US007898507B2

(12) United States Patent
Takei et al.

(10) Patent No.: US 7,898,507 B2
(45) Date of Patent: Mar. 1, 2011

(54) DISPLAY DEVICE AND ASSOCIATED DRIVE CONTROL METHOD

(75) Inventors: Manabu Takei, Sagamihara (JP); Tomoyuki Shirasaki, Higashiyamato (JP); Ikuhiro Yamaguchi, Tokyo (JP); Tsuyoshi Ozaki, Fussa (JP); Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 928 days.

(21) Appl. No.: 11/154,961

(22) Filed: Jun. 16, 2005

(65) Prior Publication Data

US 2005/0280613 A1 Dec. 22, 2005

(30) Foreign Application Priority Data

Jun. 18, 2004 (JP) ..... 2004-181764

(51) Int. Cl.
*G09G 3/30* (2006.01)

(52) U.S. Cl. ..... 345/76

(58) Field of Classification Search ..... 345/76–77
See application file for complete search history.

(56) References Cited

U.S. PATENT DOCUMENTS

| | | | | |
|---|---|---|---|---|
| 6,552,703 | B1 * | 4/2003 | Ushigusa | 345/77 |
| 6,734,636 | B2 * | 5/2004 | Sanford et al. | 315/169.3 |
| 6,873,313 | B2 * | 3/2005 | Washio et al. | 345/77 |
| 6,989,826 | B2 | 1/2006 | Kasai | |
| 2003/0030602 | A1 * | 2/2003 | Kasai | 345/76 |
| 2006/0114192 | A1 | 6/2006 | Kasai | |

FOREIGN PATENT DOCUMENTS

| | | | |
|---|---|---|---|
| CN | 1427385 | A | 7/2003 |
| JP | 11-311970 | A | 11/1999 |
| JP | 2001-051650 | A | 2/2001 |
| JP | 2002-156923 | A | 5/2002 |
| JP | 2003-114645 | A | 4/2003 |
| JP | 2004-021219 | A | 5/2004 |
| JP | 2004-151558 | A | 5/2004 |
| JP | 2005-134880 | A | 5/2005 |
| WO | WO 03/105117 | A2 | 12/2003 |

* cited by examiner

*Primary Examiner*—Amr Awad
*Assistant Examiner*—Waseem Moorad
(74) *Attorney, Agent, or Firm*—Holtz, Holtz, Goodman & Chick, PC

(57) ABSTRACT

A display device which displays image information based on display data comprising a display panel having a plurality of signal lines and scanning lines with a plurality of display pixels containing current control type light emitting devices; a scan driver circuit applies a scanning signal to each of the scanning lines and sets the display pixels connected to the scanning lines in a selective state; a signal driver circuit generates gradation current based on the display data luminosity gradation component and supplies to the display pixels set in the selective state; a precharge circuit applies a precharge voltage to each signal line and sets a capacity component attached to each of the scanning lines in a predetermined charged state; and an operation control circuit controls setting of the light emitting devices in a non-light emitting state when the capacity component is set in a predetermined charged state.

4 Claims, 22 Drawing Sheets

DISPLAY DEVICE AND ASSOCIATED DRIVE CONTROL METHOD

CROSS-REFERENCE TO RELATED APPLICATION

This application is based upon and claims the benefit of priority from the prior Japanese Patent Application No. 2004-181764, filed Jun. 18, 2004, which is entirely in incorporated herein by reference.

BACKGROUND OF THE INVENTION

1. Field of the Invention

The present invention relates to a display device and its associated drive control method. More particularly, the present invention relates to a display device and a drive control method for this display device comprising a display panel constituted with an array of plural display pixels containing current control type light emitting devices for performing a light emitting operation at a predetermined luminosity gradation by supplying current corresponding to the display data.

2. Description of the Related Art

Conventionally, a light emitting device type display (display device) comprising a display panel consisting of a two-dimensional array of display pixels equipped with current control type light emitting devices for performing a light emitting operation at a predetermined luminosity gradation corresponding to a current value of the drive current supplied to such as organic electroluminescent devices (hereinafter denoted as "organic EL devices"), Light Emitting Diodes (LEDs), etc. is well-known.

Particularly, a light emitting device type display which applies an active-matrix drive method as compared with a Liquid Crystal Display (LCD) which is widely utilized in various electronic devices including portable devices in recent years provides faster display response speed and there is no viewing angle dependency. In addition, higher luminance, higher contrast, and highly detailed display image quality, etc. are practicable. Since backlight is not needed like in the case of an LCD, this especially predominant feature increases the possibilities for further thin-shaped, light-weight, low-power display devices. Accordingly, the light emitting device type display applying the active-matrix drive method is intensively researched and developed as "the next generation" display.

Besides, in such a light emitting device type display, the drive control mechanism and control method for performing light emitting control of the above-mentioned current control type light emitting devices has been variously proposed. In addition to the above-stated light emitting devices for each of the display pixels which constitute the display panel, an apparatus comprised with a driver circuit (light emitting driver circuit) consisting of a plurality of switching circuits for performing light emitting control of these light emitting devices is well-recognized.

FIG. 23 is an outline configuration diagram showing a substantial part of a light emitting device type display in conventional prior art. FIG. 24 is an equivalent circuit diagram showing an example configuration of a display pixel (light emitting driver circuit and a light emitting device) applicable to a light emitting device type display in conventional prior art.

The active-matrix type organic EL display devices in conventional prior art, as seen in FIG. 23 outline, have a configuration comprising a display panel 110P with a plurality of display pixels EMp arranged in matrix form near each intersecting point of a plurality of scanning lines SL (selection lines) and data lines DL (signal lines) situated in row and column directions; a scan driver 120P (scanning line driver circuit) connected to each of the scanning lines SL; and a data driver 130P (data line driver circuit) connected to each of the data lines DL. A light emitting driver circuit DCp for each display pixel EMp, as shown in FIG. 24, comprises a Thin-Film Transistor Trill (TFT; hereinafter denoted as "thin-film transistor) in which the gate terminal is connected to the scanning lines SL, along with the source terminal and drain terminal respectively connected to the data lines DL and a contact N111; a thin-film transistor Tr112 in which the gate terminal is connected to the contact N111 and ground potential Vgnd is applied to the source terminal; and the organic EL devices OEL (current control type light emitting devices) configuration has the anode terminal connected to the drain terminal of the thin-film transistor Tr112 of this light emitting driver circuit DCp and low voltage Vss of lower electric potential than the ground potential Vgnd is applied to the cathode terminal.

Here, in FIG. 24, a storage capacitor Cp is connected and formed between the gate< >source of the thin-film transistor Tr112. Also, the thin-film transistor Tr111 is composed of an n-channel type thin-film transistor and the thin-film transistor Tr112 is composed of a p-channel type thin-film transistor.

In such a configuration of the display device comprising the display panel 110P consisting of the display pixels EMp, initially, by sequentially applying a high-level of the scanning signal Vsel to each row of the scanning lines SL from the scan driver 120P, the thin-film transistor Tr111 of for every row of the display pixels EMp (light emitting driver circuits DCp) perform an "ON" operation and the display pixels EMp are set in a selective state.

Synchronizing with this selection timing, the data driver 130P generates gradation signal voltage Vpix corresponding to the display data and by being applied to the data lines DL of each column, the gradation signal voltage Vpix is applied to contact N111 (namely, the gate terminal of thin-film transistor Tr112) via the thin-film transistor Tr111 of each display pixel EMp (light emitting driver circuits DCp). Accordingly, the thin-film transistor Tr112 performs an "ON" operation by the continuity condition (switch "ON/OFF" operations) corresponding to the gradation signal voltage Vpix. Predetermined light emitting drive current from ground potential Vgnd flows to the low voltage Vss via the thin-film transistor Tr112 and the organic EL device OEL. The organic EL device OEL performs a light emitting operation at a luminosity gradation which corresponds to the display data.

Subsequently, by applying a low-level of the scanning signal Vsel to the scanning lines SL from the scan driver 120P, the thin-film transistor Tr111 of each row for every line of the display pixels EMp performs an "OFF" operation and the display pixels EMp are set in a non-selective state. Thus, the data lines DL and the light emitting driver circuits DCp are electrically isolated. At this stage, based on the voltage which is applied to the gate terminal of thin-film transistor Tr112 and stored in the storage capacitor Cp, the thin-film transistor Tr112 maintains an "ON" state like the above-mentioned selective state. Predetermined light emitting drive current from ground potential Vgnd flows into the organic EL devices OEL via the thin-film transistor Tr112 and a light emitting operation continues. This light emitting operation is controlled to perform a one frame period continuance, for example, until the gradation signal voltage Vpix corresponding to the next display data is applied (written-in) to each row of the display pixels EMp.

Because such a drive control method controls the current value of the light emitting drive current flow to the organic EL devices OEL by adjusting the voltage (gradation signal voltage Vpix) applied to each display pixel EMp (gate terminal of the thin-film transistor Tr112 in the light emitting driver circuits DCp) and performs a light emitting operation at a predetermined luminosity gradation, this technique is known as a voltage assignment method (or voltage application method).

Incidentally, in the display pixels EMp comprising the light emitting driver circuits DCp that utilize such a voltage specification method, the thin-film transistor Tr111 has a selection function and the thin-film transistor Tr112 has a light emitting drive function. When variations and fluctuations (deterioration) are produced in the device characteristics (channel resistance, etc.) depending on the external environment (such as the surrounding temperature), usage time, etc., the light emitting drive current supplied to the light emitting devices (organic EL devices OEL) fluctuates. This presents a problem in that the desired light emitting characteristic (displayed at a predetermined luminosity gradation) is difficult to achieve and maintain stably over a long period of time.

Additionally, when each display pixel is made smaller for adding more pixels to achieve higher resolution of the display panel, variations in the operating characteristics (current between source< >drain), etc.) of the thin-film transistors Tr111 and Tr112 constituted in the light emitting driver circuits DCp become greater. Thus, there is a problem in that proper gradation control cannot be accomplished as variations in the light emitting characteristics of each display pixel are generated which causes deterioration of the display image quality.

Therefore, as a technique for solving such problems, a configuration of the light emitting driver circuits corresponding to a drive control method referred to as a current application method (or current assignment method) is known. Also, although the configuration example of the display pixels (light emitting driver circuits) corresponding to this current application method will be explained in the "DETAILED DESCRIPTION OF THE PREFERRED EMBODIMENTS", the following is an outline of the configuration and operation (function).

Accordingly, in the light emitting driver circuits applied to a display device corresponding to the current application method comprise a drive current control circuit (equivalent to the thin-film transistor Tr112 and the storage capacitor Cp mentioned above) which controls the current value of the light emitting drive current supplied to the light emitting devices (for example, the organic EL devices OEL, etc. mentioned above) and its supply state. Specified gradation current of a current value corresponding to the display data is directly supplied from the data driver to that drive current control circuit. Based on the voltage stored according to that current, the current value of the above-mentioned light emitting drive current and its display state are controlled. Thus, this circuit is configured so that a light emitting operation of the light emitting devices is continuously performed at a predetermined luminosity gradation.

As a result, in the light emitting driver circuits that utilize the current application method, the operation constitutes implementing both the function (current/voltage conversion function) which converts the current level of gradation current corresponding to the display data supplied to each display pixel by the drive current control circuit and the function (light emitting drive function) which supplies light emitting drive current that has a predetermined current value based on that voltage level to the light emitting devices. The variation of operating characteristics between plural thin-film transistors as shown in FIG. 24, for example, by forming the drive current control circuit with a single active device (thin-film transistor) has an advantage in that the influence exerted on the light emitting drive current can be controlled.

However, a light emitting driver circuit that employs the current application method described above has a problem as explained below.

Notably, in the light emitting driver circuits of the current assignment method, when (at time of low gradation display) writing the gradation current in each of the display pixels based on display data at the lowest or a relatively low luminosity gradation, it is necessary to supply signal current to each display pixel which has a low current value corresponding to the luminosity gradation of the display data.

Here, the operation which writes display data (gradation current) in each display pixel is equivalent to charging the capacity component (parasitic capacitance; originating in the interconnect capacitance, storage capacitor set in the display pixels, and the like) which is parasitic in the data lines up to predetermined voltage. Because this parasitic capacitance is a capacity component attached to the data lines and equivalent even if positioned anywhere (of the display pixels) above the data lines, when supplying gradation current based on the same luminosity gradation substantially the same write-in time interval is necessary.

Therefore, for example, when the number of scanning lines increases due to enlargement, higher resolution, etc. of the display panel, a selection period (namely, write-in time to each display pixel) of each the scanning lines will be set for a relatively brief interval and also the redesigned wiring length for the data lines becomes longer. When the number of display pixels connected to these data lines is increased, the above-mentioned parasitic capacitance becomes higher to the extent that particularly the current value of the gradation current becomes lower (namely, like the case of a low gradation display) as well as this parasitic capacitance is charged in briefly set write-in time intervals. As a result, write-in deficiencies occur due to the inability to fully write-in the display data to each display pixel.

Accordingly, the current value of the light emitting drive current supplied to the light emitting devices (organic EL devices) of each display pixel becomes lower as compared with the gradation current at the time of write-in (write-in current). Thus, this situation produces an unmanageable problem in executing a light emitting operation at the appropriate luminosity gradation corresponding to the display data which causes deterioration of the display image quality. Also, an in-depth simulation result relating to this problem will be explained later in the "DETAILED DESCRIPTION OF THE PREFERRED EMBODIMENTS."

SUMMARY OF THE INVENTION

The present invention features a display device which employs the drive control method of a current application method that supplies gradation current corresponding to the display data to each display pixel constituting a display panel and performs a light emitting operation at a predetermined luminosity gradation. The present invention has the advantages of being able to suppress occurrence of an insufficient write-in state due to the capacity component which is parasitic on the data lines, to perform a light emitting operation of the light emitting devices at the proper luminosity gradation and to achieve improvement of the display image quality.

The display device of the present invention for acquiring the above-mentioned advantages, the display device comprising at least: a display panel which has a plurality of signal lines and a plurality of scanning lines situated in directions to mutually intersect and a plurality of display pixels containing current control type light emitting devices, for example, composed of organic electroluminescent devices positioned near each intersecting point of those plurality of signal lines and plurality of scanning lines; a scan driver circuit which applies a scanning signal to each of the plurality of scanning lines and sets the display pixels connected to the scanning lines in a selective state; a signal driver circuit which generates gradation current based on the display data luminosity gradation component and supplies to the display pixels set in the selective state by the scan driver circuit via each of the signal lines; a precharge circuit which applies a precharge voltage to each of the plurality of signal lines and sets a capacity component attached to each of the signal lines in a predetermined charged state; and an operation control circuit which controls setting of the light emitting devices in a non-light emitting state when the capacity component is set in a predetermined charged state by the precharge circuit.

The operation control circuit sets the light emitting devices in a non-light emitting state on occasions when the gradation current is supplied to the display pixels by the signal driver circuit and during which an electric charge is stored based on the gradation current in the display pixels, sets the display pixels in a non-selective state by the scan driver and sets the light emitting devices in a state which performs a light emitting operation based on the electric charge stored in the display pixels.

The display pixels comprise a light emitting driver circuit comprising a storage capacitor which stores an electric charge based on the gradation current as a voltage component and a drive current control circuit comprising an active device which flows light emitting drive current to the light emitting devices for performing a light emitting operation based on a voltage component stored in the storage capacitor. The capacity component includes a capacitor formed within the wiring between the signal lines and the scanning lines, as well as the storage capacitor.

The precharge voltage sets the light emitting devices provided in the display pixels based on voltage charged in the storage capacitor for performing a light emitting operation at a specified luminosity gradation, for example, composed of the lowest gradation in a range of luminance gradations; or sets voltage charged in the storage capacitor so as to constitute voltage which does not cause an "ON" state in the active device formed in the drive current control circuit.

The precharge circuit comprises a switching circuit which simultaneously applies the precharge voltage to all the signal lines situated in the display panel. The scan driver circuit generates and outputs a precharge control signal which controls the precharge circuit operating state. The operation control circuit controls setting of the display pixels in a non-selective state by the scan driver circuit when the capacity component is set in a predetermined charged state by the precharge circuit or setting any selective state.

Additionally, the display device further comprises a reset circuit which discharges the electric charge stored at least in the display pixels and sets the display pixels in a reset state; and the operation control circuit controls setting of the display pixels in a selective state by the scan driver circuit when discharging the electric charge stored in the display pixels by the reset circuit.

The reset circuit comprises a switching circuit which simultaneously applies a reset voltage to all the signal lines and discharges the electric charge stored in the storage capacitor.

The scan driver circuit comprises a means which sequentially applies the scanning signal to each of the plurality of scanning lines and sequentially sets the display pixels for each arrayed row of the display panel in a selective state and a means which simultaneously applies the scanning signal to all the scanning lines and simultaneously sets all the display pixels arrayed in the display panel in a selective state. Also, the scan driver further comprises a means which generates and outputs a reset control signal for controlling the reset circuit operating state.

A drive control method of the display device in the present invention for acquiring the above-mentioned advantages, the drive method comprises at least: setting the light emitting devices in a non-light emitting state as precharge voltage which is applied to each of the plurality of signal lines and setting a capacity component attached to each of the signal lines as a predetermined charged state; setting the display pixels in a selective state and setting the light emitting devices in a non-light emitting state; supplying a gradation current to the display pixels via each of the plurality of signal lines based on the display data luminosity gradation component and storing an electric charge based on the gradation current in the display pixels; and setting the display pixels in a non-selective state and setting the light emitting devices in a state which performs a light emitting operation based on the electric charge stored in the display pixels.

The capacity component includes a capacitor formed within the wiring between the signal lines and the scanning lines. The capacity component further includes a storage capacitor formed in the display pixels which contribute to a light emitting operation of the light emitting devices. The precharge voltage sets the light emitting devices provided in the display pixels based on voltage charged in the storage capacitor for performing a light emitting operation at a specified luminosity gradation, for example, composed of the lowest gradation in a tonal range of luminance gradations; or sets voltage charged in the storage capacitor so as to constitute voltage which does not cause an "ON" state in an active device for light emitting drive that contributes to a light emitting operation of the light emitting devices.

The operation of setting the capacity component in a predetermined charged state executes only once at timing before operation of supplying the gradation current to the display pixels corresponding to each of the scanning lines; or executes every cycle for each timing that supplies the gradation current to the display pixels corresponding to each of the scanning lines. Also, the operation of setting the capacity component in a predetermined charged state is executed in setting state of the display pixels in any selective state or non-selective state.

The drive control method of the display device further comprises: setting the display pixels as a selective state; applying reset voltage to the signal lines; discharging an electric charge stored by the storage capacitor provided at least in the display pixels; and setting the display pixels in a reset state. The operation of setting the display pixels in a reset state executes only once at timing before operation of supplying the gradation current to the display pixels corresponding to each of the scanning lines; or executes every cycle for each timing that supplies the gradation current to the display pixels corresponding to each of the scanning lines.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Figure 1:
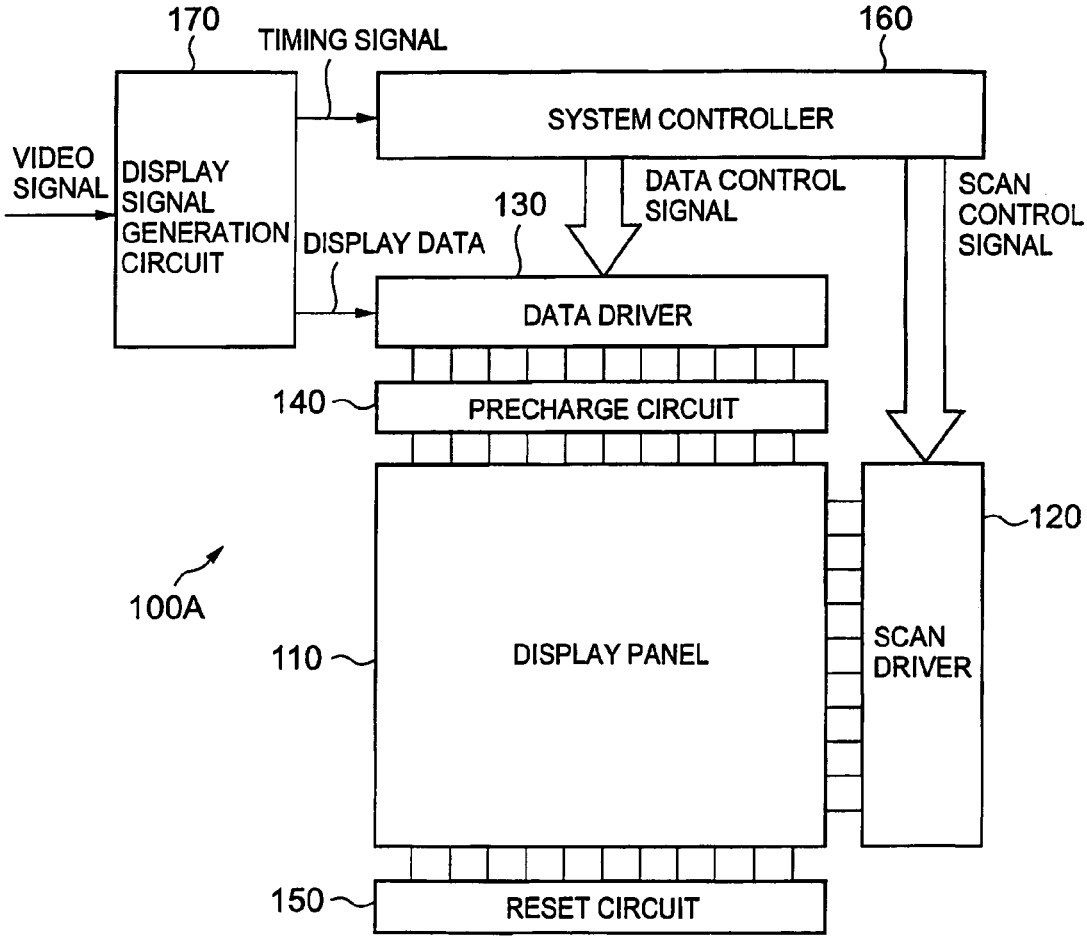
FIG. 1 is a schematic block diagram showing the $1^{st}$ embodiment of the display device related to the present invention.

Hereinafter, the details of the display device and associated drive control method related to the present invention will be explained based on the preferred embodiments shown in the drawings.

$1^{st}$ Embodiment

Display Device

Initially, the $1^{st}$ embodiment of the display device related to the present invention will be explained with reference to the drawings.

FIG. 1 is a schematic block diagram showing the $1^{st}$ embodiment of the display device related to the present invention.

Figure 2:
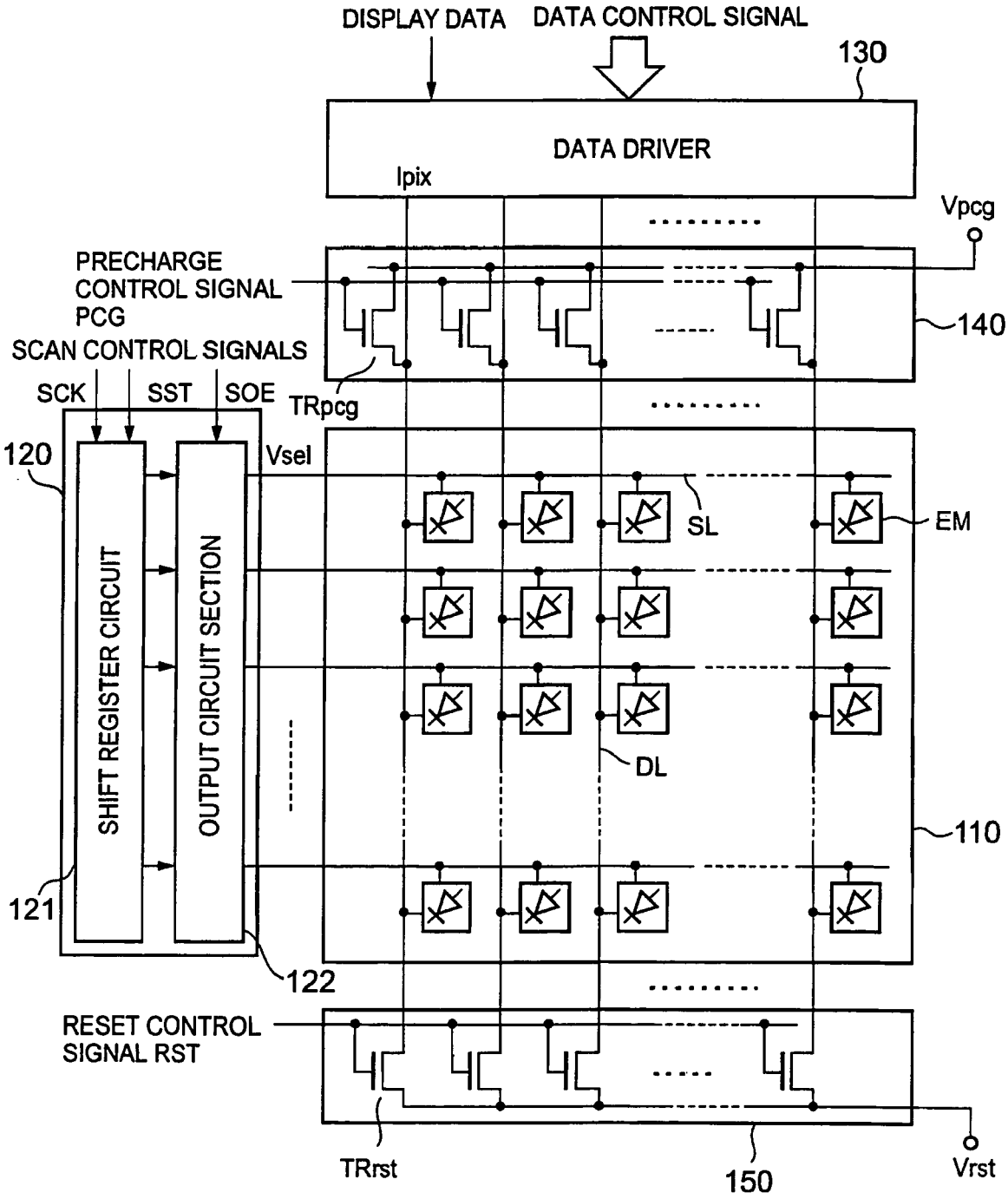
FIG. 2 is an outline configuration diagram showing the substantial part composition of the display device related to the $1^{st}$ embodiment.

FIG. 2 is an outline configuration diagram showing the substantial part composition of the display device related to the $1^{st}$ embodiment.

Figure 23:
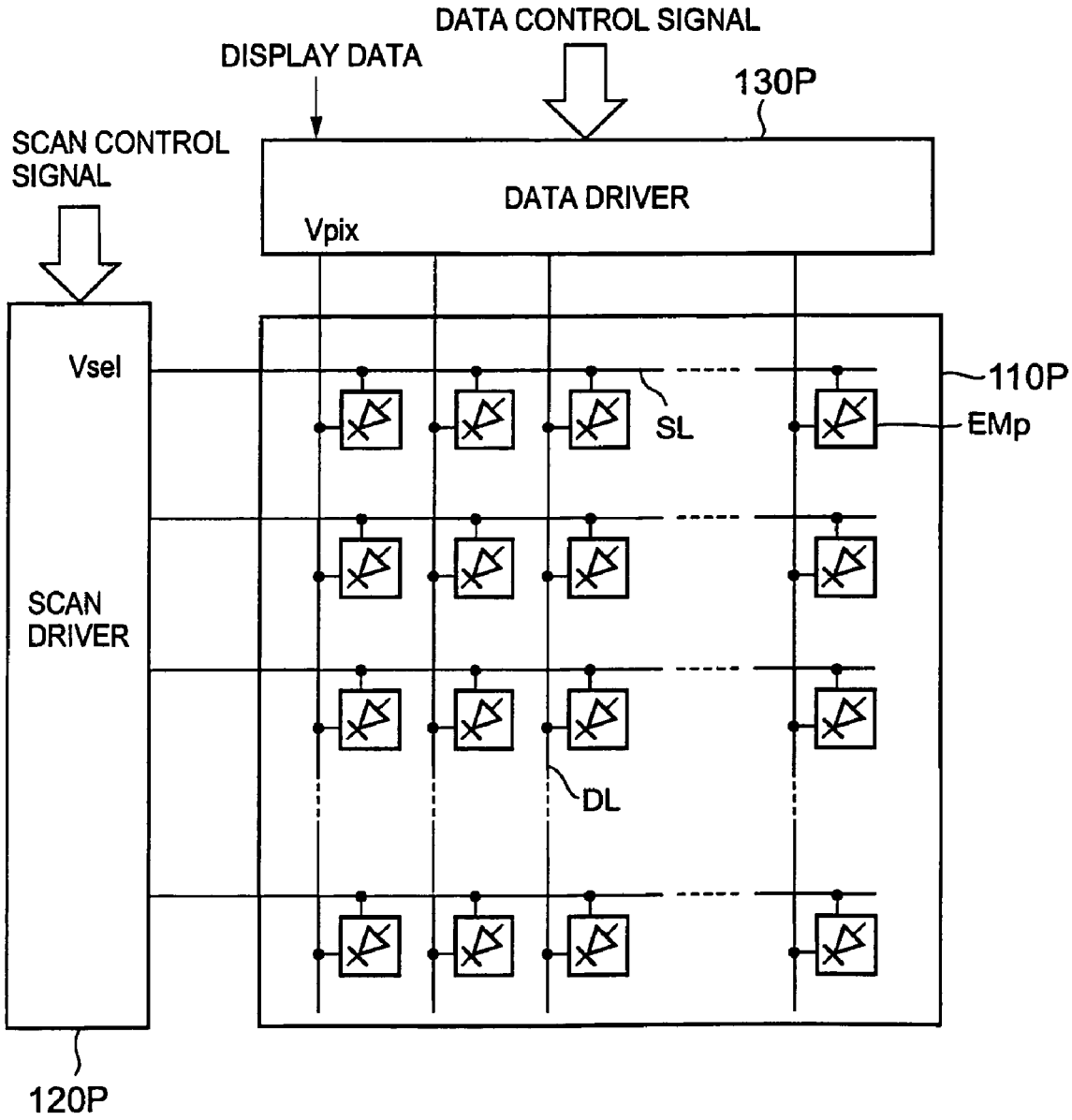
FIG. 23 PRIOR ART
FIG. 23 is an outline configuration diagram showing the substantial part of a light emitting device type display in conventional prior art.
Figure 24:
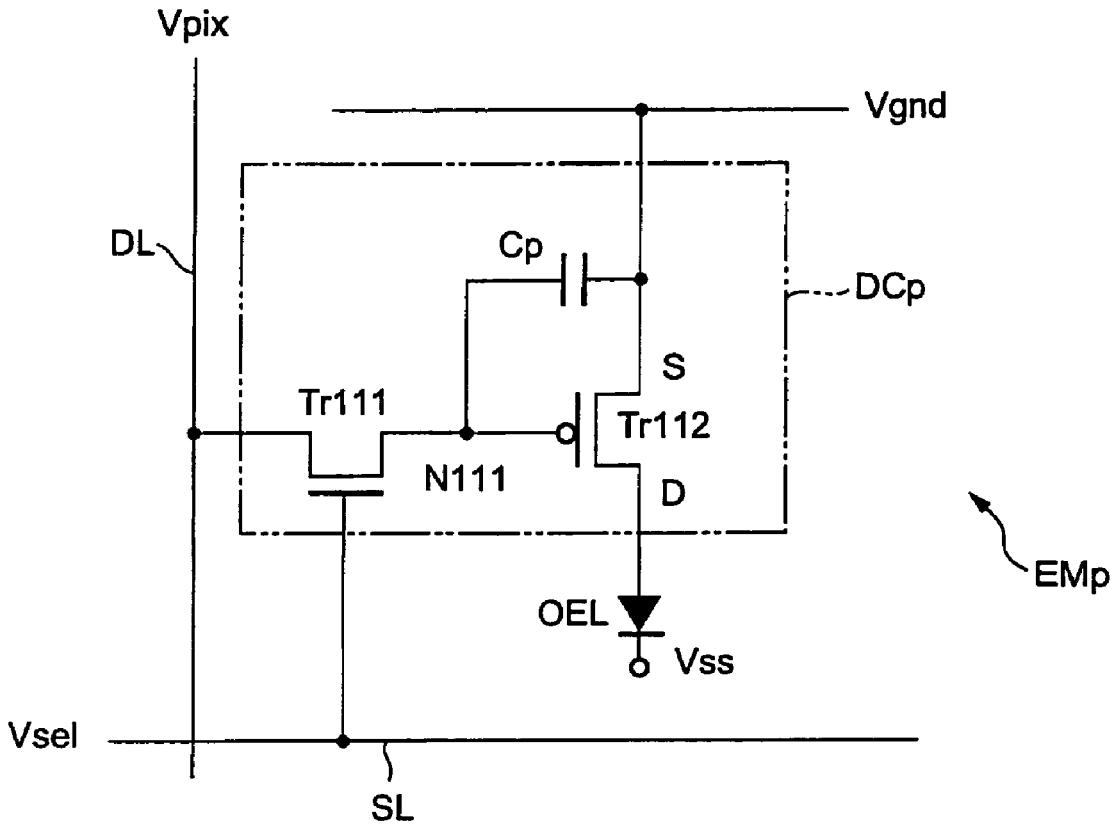
FIG. 24 PRIOR ART
FIG. 24 is an equivalent circuit diagram showing an example configuration of a display pixel (light emitting driver circuit and a light emitting device) applicable to a light emitting device type display in conventional prior art.

Here, concerning any configuration equivalent to the conventional prior art (FIG. 23) mentioned above, the same or equivalent nomenclature is appended.

As seen in FIG. 1 and FIG. 2, the display device 100A related to this embodiment, in summary, has a configuration comprising a display panel 110, a scan driver 120 (scan driver circuit), a data driver 130 (signal driver circuit), a precharge circuit 140, a reset circuit 150, a system controller 160 (operation control circuit) and a display signal emitting circuit 170. The display panel 110 contains a two-dimensional array (for instance, an array in matrix form composed of n rows×m columns) having a plurality of display pixels EM, for example, each composed of a light emitting driver circuit and a current control type light emitting device described later, near each intersecting point of a plurality of scanning lines SL and a plurality of data lines DL (signal lines) situated in directions to mutually intersect. The scan driver 120 (scan driver circuit) sets the display pixels EM for every row in a selective state by connecting to the scanning lines SL of the display panel 110 and applies a scanning signal Vsel to each of the scanning lines SL at predetermined timing. The data driver 130 (signal driver circuit) connects to the data lines DL of the display panel 110, takes in the display data supplied from a display signal generation circuit 170 described later and supplies a gradation current Ipix corresponding to that display data to each of the data lines DL at predetermined timing. The precharge circuit 140 connects to the data lines DL and applies a precharge voltage Vpcg to each of the data lines DL at predetermined timing before the gradation current Ipix is supplied from the above-mentioned data driver 130. The reset circuit 150 connects to the data lines DL and applies a reset voltage Vrst to each of the display pixels EM at predetermined timing before the precharge voltage Vpcg is applied from the above-mentioned precharge circuit 140. The system controller 160 (operation control circuit) generates and outputs scan control signals and data control signals which control each operating state of at least the scan driver 120 and the data driver 130 based on a timing signal supplied from the display signal generation circuit 170. The display signal generation circuit 170 extracts or generates timing signals (system clock, etc.) for displaying predetermined image information on the display panel 110 based on that display data.

Hereinafter, each of the above-mentioned components will be explained in detail.

(Display Panel)

As seen in FIG. 2, the display pixels EM arranged in the display panel 110 are configured to selectively execute a write-in operation and a light emitting operation. The write-in operation takes in the gradation current Ipix supplied to each of the data lines DL from the data driver 130 and stores a voltage component corresponding to that gradation-current Ipix based on timing of the scanning signal Vsel applied to each of the scanning lines SL from the scan driver 120 described later. The light emitting operation supplies light emitting drive current based on this voltage component to the light emitting devices for producing light emission at a predetermined luminosity gradation.

Specifically, the display pixels EM as applied to this embodiment, are set in a selective state (selection period) by applying the scanning signal Vsel of a selection level (for example, high-level). As the gradation current Ipix is supplied and the display data written in (write-in operation), the supply of light emitting drive current to the light emitting devices is electrically isolated and constitutes a non-light emitting state. Conversely, the display pixels EM are set in a non-selective state (non-selection period) by applying a scanning signal Vsel of a non-selection level (for example, low-level). Light emitting drive current based on the gradation current Ipix written in by the above-mentioned write-in operation is supplied to the light emitting devices which produces light emission at a predetermined luminosity gradation in the light emitting devices and constitutes a light emitting operation state. In addition, an example of a concrete circuit and the circuit operation of the display pixels EM (light emitting driver circuits) as applied to the display panel related to this embodiment will be described later in detail.

(Scan Driver)

The scan driver 120 sets the display pixels EM for every row in a selective state by sequentially applying the scanning signal Vsel of a selection level (for example, high-level) to each of the above-mentioned scanning lines SL based on scan control signals supplied from the system controller 160 and controls the write-in of the gradation current Ipix to each of the display pixels EM based on the display data supplied via each of the data lines DL by the data driver 130 during the period (selection period) set in a selective state.

As seen in FIG. 2, the scan driver 120 has a configuration comprising a shift register 121 and an output circuit section 122. The shift register 121 sequentially outputs a shift signal corresponding to each row of the scanning lines SL based on a scanning clock signal SCK and a scanning start signal SST supplied as scan control signals from the system controller 160 described later. With the output circuit section 122, the shift signal outputted from that shift register 121 is converted into a predetermined signal level (high-level) and outputs to each of the scanning lines SL as the scanning signal Vsel based on an output control signal SOE supplied as a scan control signal from the system controller 160.

Here, the scan driver 120 related to this embodiment and more particularly the output circuit section 122 has a function (mode) which sequentially outputs the shift signal sequentially outputted from the shift register 121 mentioned above to each of the scanning lines SL as the scanning signal Vsel as well as a function (mode) which simultaneously outputs the scanning signal Vsel to all the scanning lines SL regardless of a shift signal from the shift register 121. The configuration of these functions is switchable based on the above-mentioned output control signal SOE.

Specifically, during operation (image display operation) which supplies the gradation current Ipix to each row of the display pixels EM situated in the display panel 110 and sequentially writes in the display data as described later, the mode is set which sequentially outputs the scanning signal Vsel to each of the scanning lines SL and an electric charge stored (residue) in all of the display pixels EM situated in the display panel 110 is discharged. During operation (reset operation) set in a reset state, the mode is set which simultaneously outputs the scanning signal Vsel to all of the scanning lines SL.

(Data Driver)

Figure 3:
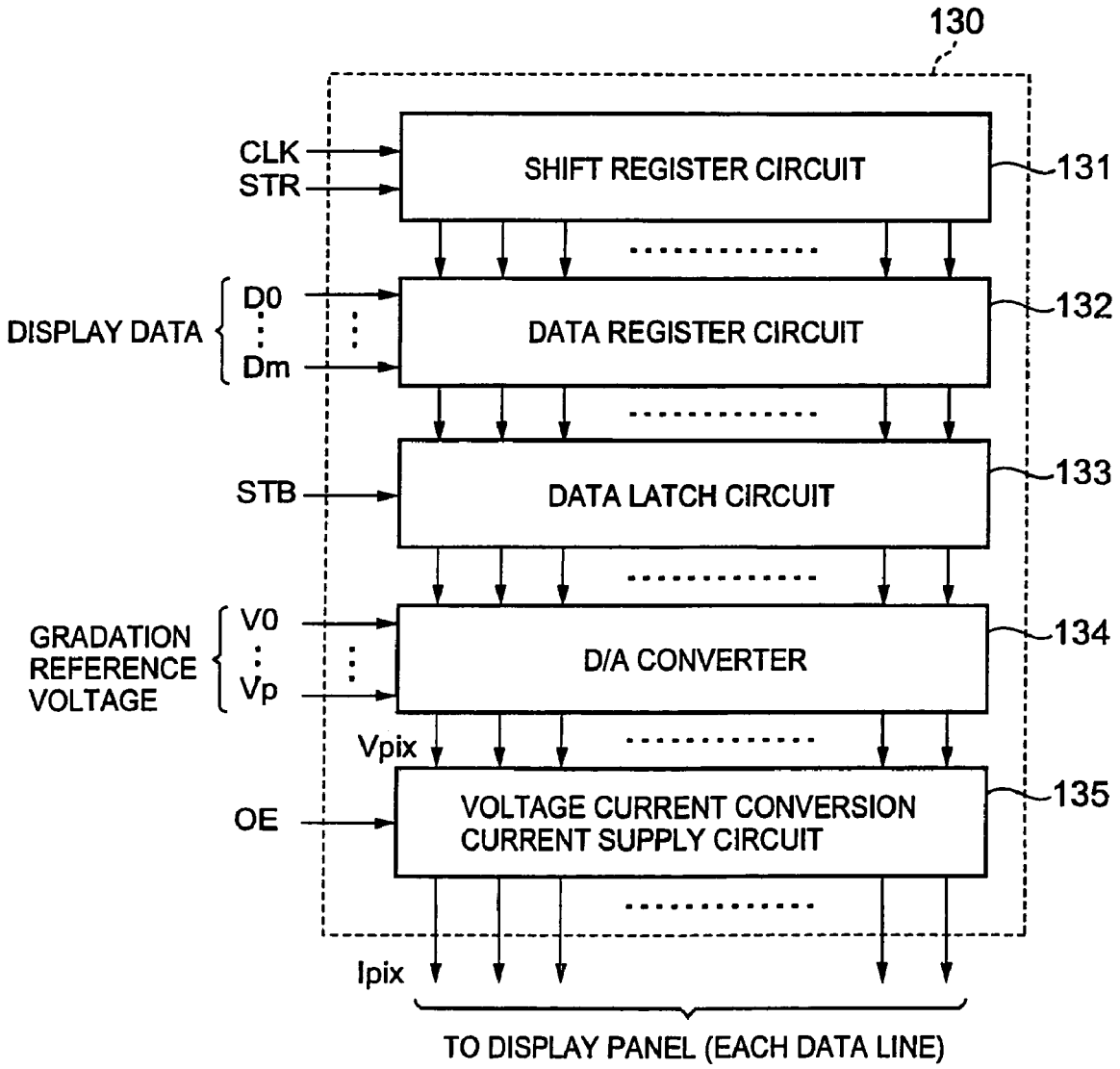
FIG. 3 is a schematic block diagram showing an example of a data driver applicable to the display device related to the $1^{st}$ embodiment.

FIG. 3 is a schematic block diagram showing an example of a data driver applicable to the display device related to the $1^{st}$ embodiment.

Figure 4:
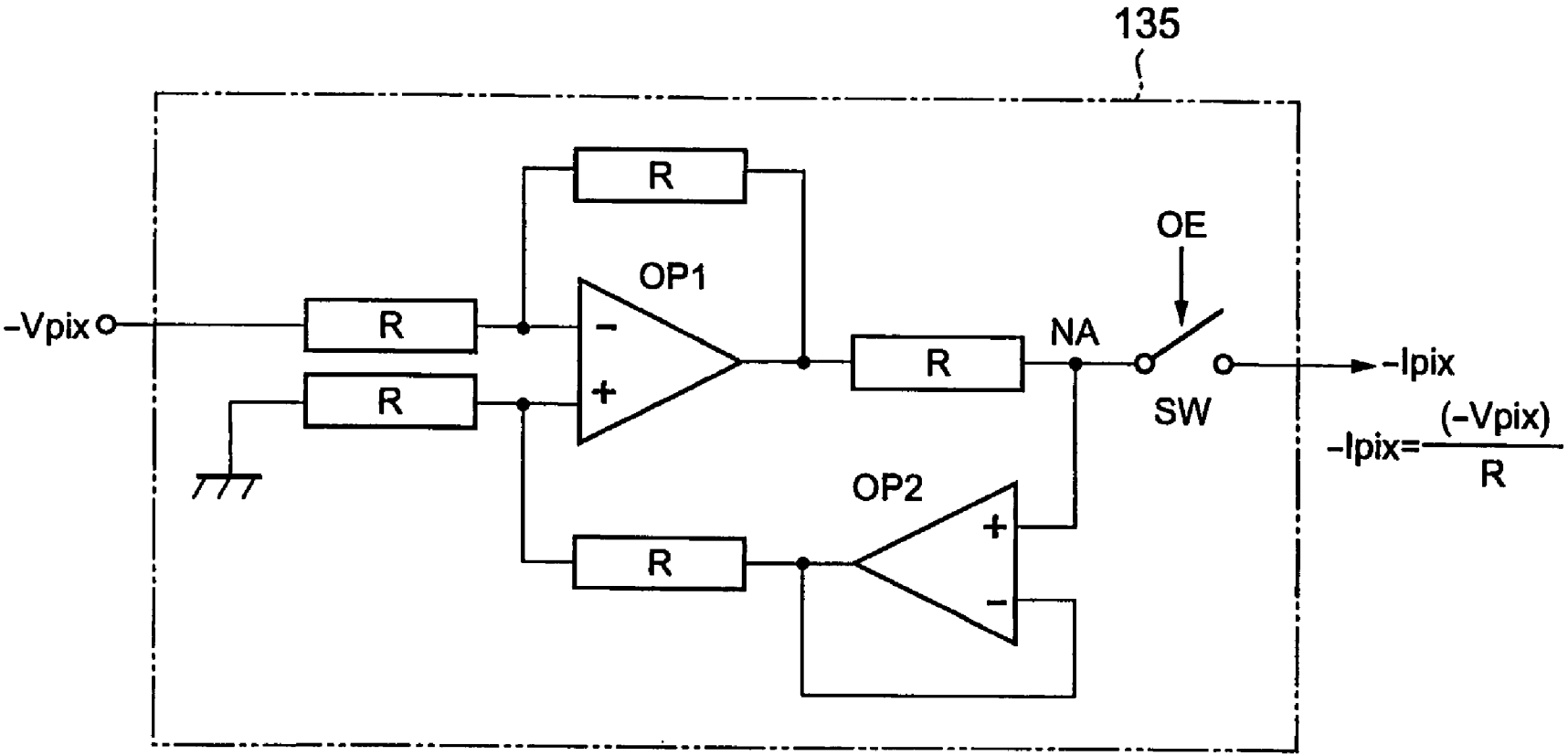
FIG. 4 is a circuit configuration diagram showing an example of a voltage current conversion•current supply circuit applicable to the data driver related to the $1^{st}$ embodiment.

FIG. 4 is a circuit configuration diagram showing an example of a voltage current conversion•current supply circuit applicable to the data driver related to the $1^{st}$ embodiment.

The data driver 130, based on data control signals supplied from the system controller 160, sequentially takes in and holds the display data for every 1 row segment at predetermined timing which is composed of a digital signal supplied from the display signal generation circuit 170 described later; generates the gradation current Ipix which has a current value corresponding to a gradation value of that display data; and simultaneously supplies each of the data lines DL during every set selection period for each of the above-mentioned scanning lines SL.

Specifically, the data driver 130 shown in FIG. 3 configuration comprises a shift register circuit 131, a data register circuit 132, a data latch circuit 133, a D/A converter 134 (Digital-to-Analog converter) and a voltage current conversion•current supply circuit 135. The shift register circuit sequentially outputs a shift signal based on data control signals (a shift clock signal CLK, a sampling start signal STR) supplied from the system controller 160. The data register circuit 132 sequentially takes in display data D0~Dm for 1 row segments supplied from the display signal generation circuit 170 based on the input timing of that shift signal. The data latch circuit 133 holds the display data D0~Dm for 1 row segments taken in by the data register circuit 132 based on a data control signal (data latch signal STB). The D/A converter 134 (Digital-to-Analog converter) converts the above-mentioned held display data D0~m (drive gradation value) into predetermined analog signal voltage (a gradation voltage Vpix) based on a gradation reference voltage V0~Vp supplied from a power supply circuit (not illustrated). The voltage current conversion•current supply circuit 135 simultaneously outputs the gradation current Ipix to each display pixel EM via each of the data lines DL at timing based on a data control signal (output enable signal OE) which generates the gradation current Ipix corresponding to the display data converted to an analog signal and supplies from the system controller 160.

In addition, the voltage current conversion•current supply circuit 135 as applicable to the data driver 130, for example as illustrated in FIG. 4, has a circuit configuration comprising an operational amplifier OP1, an operational amplifier OP2 and a switching circuit SW. The operational amplifier OP1 by which the gradation voltage (−Vpix) of reversed polarity is inputted into one input terminal (negative input terminal (−)) via an input resistor R, the reference voltage (ground potential) is inputted into the output terminal (positive input terminal (+)) on the other side via an input resistor R, and the output terminal is connected to the input terminal (−) via a feedback resistor R. The operational amplifier OP2 by which the electric potential of contact NA set in the output terminal of the operational amplifier OP1 via an output resistor R is inputted into one input terminal (+) and the output terminal is connected to the input terminal (−) on the other side, as well as connected with the input terminal (+) of the operational amplifier OP1 via an output resistor R. The switching circuit SW is connected with contact NA between the data lines DL and performs "ON/OFF" operations based on the output enable signal OE.

In such a manner like the voltage current conversion•current supply circuit 135, based on a circuit configuration set for every data line DL, the generated negative polarity gradation current (−Ipix) is defined as −Ipix=(−Vpix)/R in relation to the inputted negative polarity gradation voltage (−Vpix). Also, based on the output enable signal OE, the supply state of the gradation current Ipix to each of the data lines DL is controlled. Furthermore, in the circuit configuration shown in FIG. 4, because the generated gradation current Ipix constitutes negative polarity, the operating state controls by drawing (flowing) the relevant current toward the data driver 130 side from the data lines DL side.

(Precharge Circuit)

The precharge circuit 140 controls so as to simultaneously apply the precharge voltage Vpcg to all of the data lines DL at predetermined timing before (preceding) the timing which supplies the gradation current Ipix based on the display data to each of the data lines DL from the above-mentioned data driver 130 based on a precharge control signal PCG and to set the parasitic capacitance attached at least to each of the data lines in a predetermined charged state.

In the precharge circuit 140, for example, a configuration which provides a plurality of switching elements (switching circuits) for controlling the application state of the precharge voltage Vpcg to each of the data lines DL can be applied by connecting one end side to the voltage source (not shown) of the precharge voltage Vpcg and simultaneously performing "ON/OFF" operations based on the precharge control signal PCG for each of the data lines DL situated in the display panel 110. As these switching elements, specifically as shown in FIG. 2, the thin-film transistors TRpcg are excellently suitable by mutually applying the precharge voltage Vpcg to one end of the current path with the other end connected to each of the data lines DL.

Here, the precharge control signal PCG which controls to apply the precharge voltage Vpcg to each of the data lines DL precedes the write-in operation of the display data to each of the display pixels EM. More specifically, the device primarily necessitates applying the scanning signal Vsel to each of the scanning lines SL by the scan driver 120, applying the precharge voltage Vpcg to each of the data lines DL prior to the timing which sets each row of the display pixels EM in a selective state and charging the parasitic capacitance. Thus, the related application timing of the scanning signal Vsel (in other words, applied at timing prior to operation which sets a selective state for sequentially applying the scanning signal Vsel to each row of the scanning lines SL), for example, can be based on a scan control signal generated and outputted by the scan driver 120, as well as generated by the system controller 160 and output directly to the precharge circuit 140. Furthermore, in a concrete configuration example (refer to FIG. 8) described later, a case is shown where the scan driver 120 generates and outputs the precharge control signal PCG.

Although the precharge voltage Vpcg will be described later in detail, after charging at least the capacitor within the wiring attached to each of the data lines DL by the precharge circuit 140, when setting each row of the display pixels EM in a selective state and writing the gradation current Ipix based on the display data, the electric charge charged in the capacitor within the wiring is set so that the light emitting drive current supplied to each of the light emitting devices constitutes a current value by the lowest gradation when performing a light emitting operation of the light emitting devices. Besides, this electric charge is based on voltage (gate voltage of the transistor for light emitting drive described later) generated throughout the distribution within the storage capacitor formed in each of the display pixels EM.

Furthermore, the application timing of the precharge voltage Vpcg to each of the data lines DL only needs to be at timing prior to the display data write-in (supply of gradation current Ipix) to each row of the display pixels EM. For example as described later, the precharge voltage Vpcg can be applied and charged once to each of the data lines DL at timing before the write-in operation to each row of the display pixels EM, as well as applied and charged every cycle to each of the data lines DL for each timing directly before each row of the display pixels EM is set in a selective state.

(Reset Circuit)

The reset circuit 150 controls in order to simultaneously apply the reset voltage Vrst to all of the display pixels via each of the data lines DL at predetermined timing before the timing which applies the precharge voltage Vpcg to each of the data lines DL from the above-mentioned precharge circuit 140 based on the reset control signal RST and to discharge the electric charge stored in the storage capacitor provided in each of the display pixels EM.

The reset circuit 150, for example, a configuration which provides a plurality of switching elements (switching circuits) for controlling the application state (namely, the discharged state of the electric charge stored in each of the display pixels EM) of the reset voltage Vrst to each of the data lines DL can be applied by connecting one end side to the voltage source (not shown) of the reset voltage Vrst and simultaneously performing "ON/OFF" operations based on the reset control signal RST. These switching elements, specifically as shown in FIG. 2, the thin-film transistors TRrst are excellently suitable by mutually applying the reset voltage Vrst to one end of the current path and the other end is connected to each of the data lines DL.

Here, the reset control signal RST which controls to apply the reset voltage Vrst to each of the display pixels EM via each of the data lines DL precedes the timing which applies the above-mentioned precharge voltage Vpcg to each of the data lines DL. More specifically, the device primarily necessitates applying the reset voltage Vrst via each of the data lines DL and discharging the electric charge stored in the storage capacitor of all of the display pixels EM. Thus, the related application timing of the scanning signal Vsel (in other words, synchronized to timing which sets all of the display pixels EM in a selective state for applying the scanning signal Vsel simultaneously to all rows of the scanning lines SL), for example, can be based on a scan control signal generated and outputted by the scan driver 120, as well as generated by the system controller 160 and output directly to the reset circuit 150. Furthermore, in a concrete configuration example (refer to FIG. 8) described later, a case is shown where the scan driver 120 generates and outputs the reset control signal RST.

Although the reset voltage Vrst will be described later in detail, the circuit necessitates relatively low voltage to a level which can suitably discharge at least the electric charge stored in the storage capacitor of each of the display pixels EM, for example, set as the voltage (i.e., ground voltage) of the cathode terminal side of the light emitting devices provided in each of the display pixels EM.

Moreover, the application timing (discharge timing of the electric charge stored in the storage capacitor of each display pixel) of the reset voltage Vrst to each of the data lines DL is at timing prior to the display data write-in (supply of gradation current Ipix) to each row of the display pixels EM, and further necessary at timing before applying the above-mentioned precharge voltage Vpcg to each of the data lines DL. For example, as described later, the electric charge of each of the display pixels EM can be discharged only once at timing before the operation which applies the precharge voltage Vpcg to each of the data lines DL, as well as the electric discharge of each of the display pixels EM can be discharged every cycle directly before timing which applies the precharge voltage Vpcg.

(System Controller)

The system controller 160, at least, outputs scan control signals and data control signals for controlling the operating state relative to the above-mentioned scan driver 120 and the data driver 130. In this manner, each driver operation is controlled at predetermined timing to generate the scanning signal Vsel and the gradation current Ipix that output to the display panel 110 and to execute a light emitting operation by writing the display data generated by the display signal generation circuit 170 to each of the display pixels EM for displaying predetermined image information.

In addition, the system controller 160 controls operations in the precharge circuit 140 and reset circuit 150 by supplying scan control signals to the scan driver 120 as mentioned above. Each circuit can be operated at predetermined timing to generate the precharge control signal PCG and the reset control signal RST for output relative to the precharge circuit 140 and the reset circuit 150. With the above-mentioned the system controller 160, each circuit can also be made to operate at predetermined timing with the precharge control signal PCG and the reset control signal RST generated and output directly relative to the precharge circuit 140 and the reset circuit 150.

(Display Signal Generation Circuit)

The display signal generation circuit 170, for example, extracts a luminosity gradation signal component from the video signal supplied from the exterior of the display device 100 and supplies the display data (luminosity gradation data) for every 1 row segment of the display panel 110 to the data driver 130. Here, when the above-mentioned video signal includes a timing signal component which specifies the display timing of the image information, such as a television broadcasting signal (composite video signal), the display signal generation circuit 170 may also have a function which extracts the timing signal component besides the function which extracts the above-mentioned luminosity gradation signal component and supplies to the system controller 160. In this case, the above-mentioned system controller 160 generates the scan control signals and data control signals which are supplied to the scan driver 120 or the data driver 130 based on a timing signal supplied from the display signal generation circuit 170.

<Illustrative Example of a Display Pixel>

Next, a concrete circuit example of the display pixels situated in the above-mentioned display panel will be explained with reference to the drawings.

Figure 5:
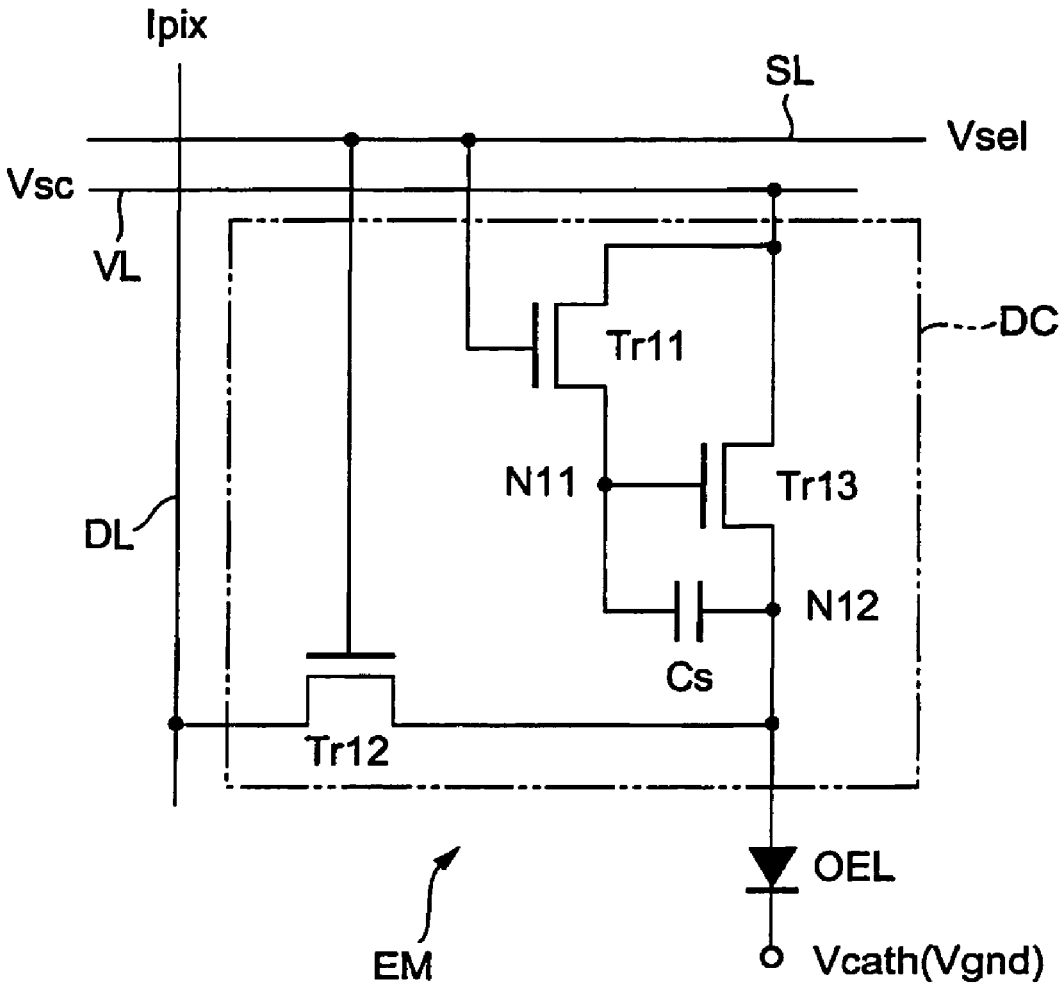
FIG. 5 is a circuit configuration diagram showing an illustrative example of a display pixel (light emitting driver circuit) applicable to the display device related to the $1^{st}$ embodiment.

FIG. 5 is a circuit configuration diagram showing an illustrative example of a display pixel (light emitting driver circuit) applicable to the display device related to the $1^{st}$ embodiment.

As seen in FIG. 5, the display pixels EM related to this embodiment, in summary, individually have a configuration comprising a light emitting driver circuit DC and a current control type light emitting device. The light emitting driver circuit DC takes in the gradation current Ipix supplied from the data driver 130 in a selective state and flows light emitting drive current corresponding to that gradation current Ipix to a light emitting device. The current control type light emitting device contains an organic EL device OEL, etc. and performs a light emitting operation at a predetermined luminosity gradation based on light emitting drive current supplied from the light emitting driver circuit DC.

Specifically, the light emitting driver circuit, for example as seen in FIG. 5, has a configuration comprising an n-channel type thin-film transistor Tr11, an n-channel type thin-film transistor Tr12, an n-channel type thin-film transistor Tr13 (drive current control circuit, active device for use in light emitting drive) and a storage capacitor Cs. The n-channel type thin-film transistor Tr11 is respectively connected with the gate terminal to the scanning lines SL, the source terminal to the voltage lines VL (power supply voltage) and the drain terminal to a contact N11. The n-channel type thin-film transistor Tr12 is respectively connected with the gate terminal to the scanning lines SL, accompanied by the source terminal and the drain terminal to the data lines DL and a contact N12. The n-channel type thin-film transistor Tr13 (drive current control circuit, active device for use in light emitting drive) is respectively connected with the gate terminal to the contact N11, accompanied by the source terminal and the drain terminal to the voltage lines VL and the contact N12. The storage capacitor is connected between the contact N11 and the contact N12. The organic EL device OEL is respectively connected with the anode terminal to the contact N12 and the cathode terminal to predetermined low electric potential voltage Vcath (for example, ground voltage vgnd). Here, the storage capacitor Cs can be a capacity component formed between the gate< >source of the thin-film transistor Tr13.

FIG. 6 is a conceptual diagram showing the operating state of the light emitting driver circuit related to the embodiments.

Figure 7:
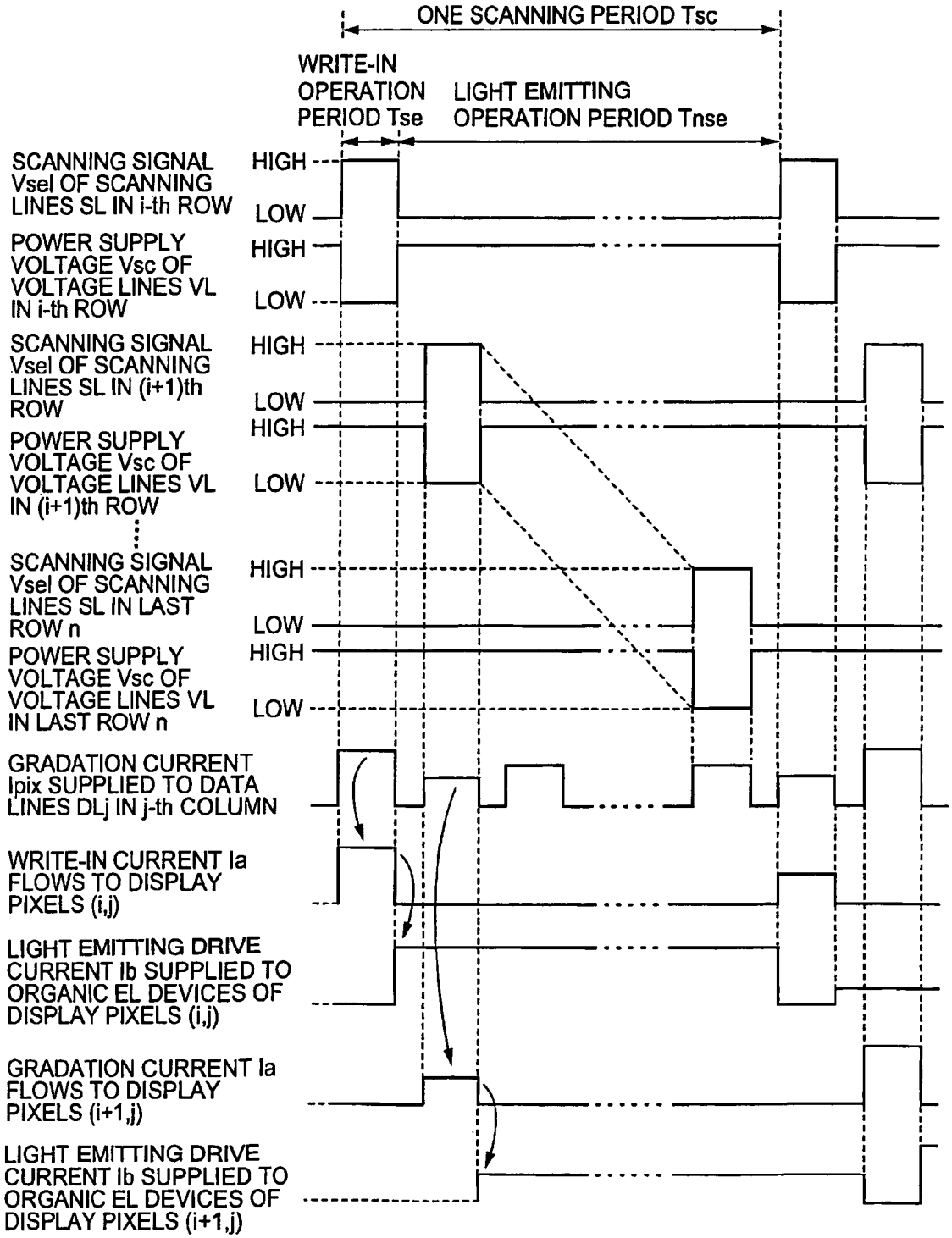
FIG. 7 is a timing chart showing the basic operation of the display pixels as applied to the light emitting driver circuit related to the embodiment.

FIG. 7 is a timing chart showing the basic operation of the display pixels as applied to the light emitting driver circuit related to the embodiment.

Figure 8:
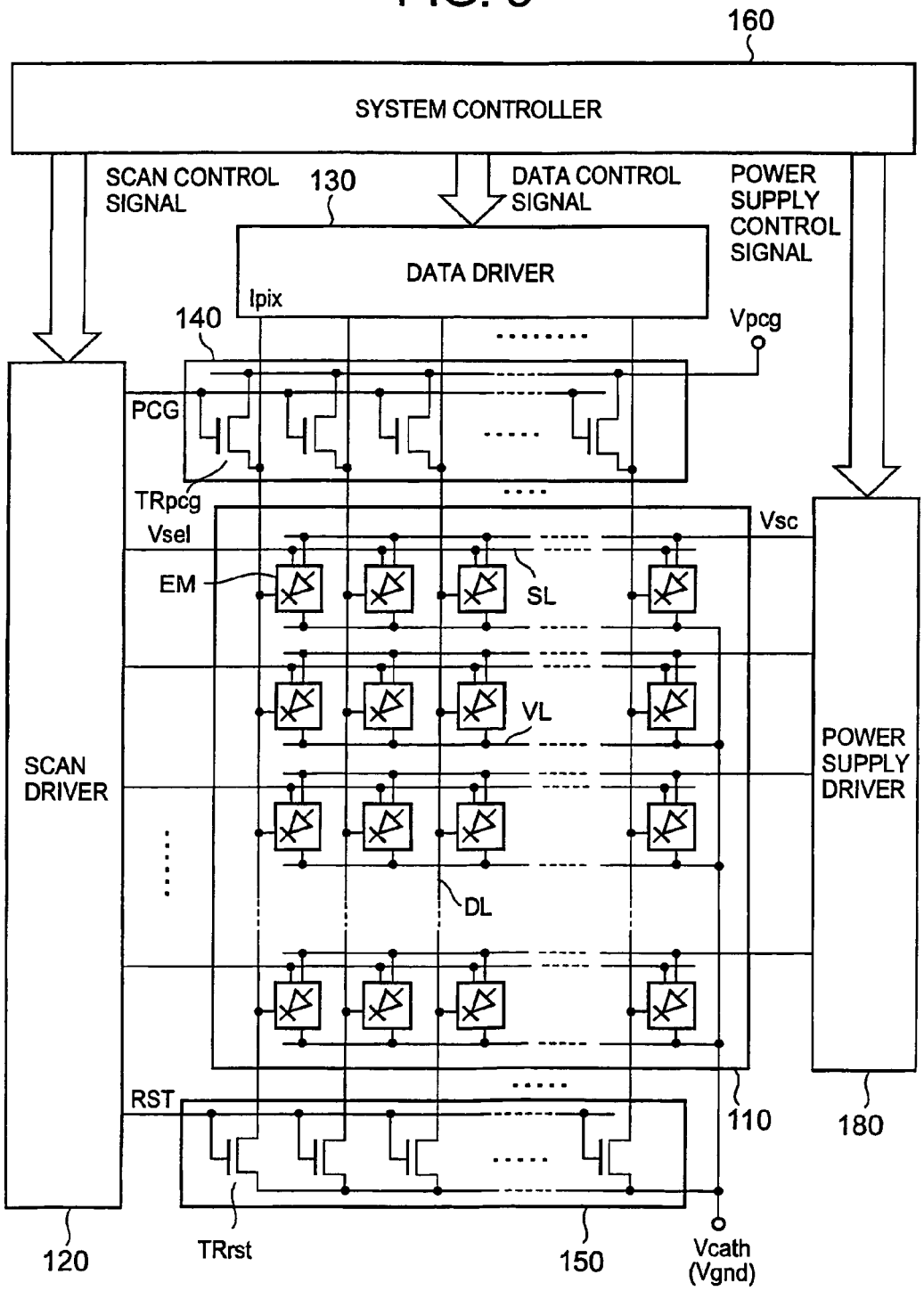
FIG. 8 is a schematic block diagram showing an example of one configuration of the display device as applied to the display pixels related to the embodiment.

FIG. 8 is a schematic block diagram showing an example of one configuration of the display device as applied to the display pixels related to the embodiment.

The light emitting drive control of the light emitting devices (organic EL devices OEL) in the light emitting driver circuits DC which contains the above-mentioned configuration, for example as seen in FIG. 7, executes by setting (Tsc>=Tse+Tnse). One scanning period Tsc denotes 1 cycle. A write-in operation period Tse (selection period) selects the display pixels EM connected to the scanning lines SL, writes the gradation current Ipix corresponding to the display data and is held as a voltage component within that one scanning period Tsc. A light emitting operation period Tnse (non-selection period) supplies light emitting drive current corresponding to the above-mentioned display data to the organic EL devices OEL and performs a light emitting operation at a predetermined luminosity gradation based on the held voltage component written in the write-in operation period Tse.

In addition, in the drive control method of the display device applied to this embodiment as described later, because a reset operation and a precharge operation are executed prior to a sequence of light emitting drive operations composed of the write-in operation and the light emitting operation of the above-mentioned light emitting driver circuits DC, the total time of the write-in operation period Tse and the light emitting operation period Tnse are set to be briefer than one scanning period Tsc (Tsc>Tse+Tnse).

(Write-In Operation Period)

Specifically, in the write-in operation period Tse of the display pixels, as shown in FIG. 7, as a high-level of the scanning signal Vsel is applied to specified scanning lines SL from the scan driver 120 and the appropriate rows of the display pixels EM are set in a selective state, a low-level of the power supply voltage Vsc is applied to the voltage lines VL of the appropriate rows of the display pixels EM. Furthermore, synchronizing with this timing, the gradation current (−Ipix) of negative polarity is supplied to each of the data lines DL which has a current value corresponding to the appropriate rows of the display data from the data driver 130.

Accordingly, as the thin-film transistors Tr11 and Tr12 constituted in the light emitting driver circuits DC perform an "ON" operation due to the low-level power supply voltage Vsc being applied to the contact N11 (namely, the gate terminal of the thin-film transistor Tr13 and one end of the storage capacitor Cs), an operation draws in the gradation current (−Ipix) of negative polarity via the data lines DL and a voltage level of the low electric potential is applied to the contact N12 (namely, the source terminal of the thin-film transistor Tr13 and the other end of the storage capacitor Cs) rather than the low-level power supply voltage Vsc.

Figure 6A:
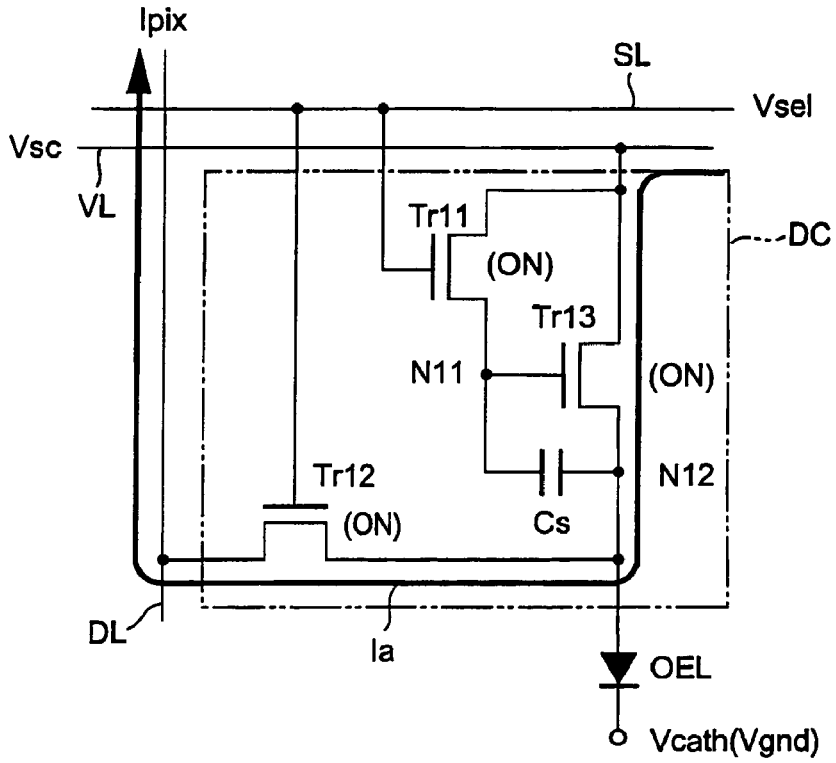
FIGS. 6A~6B are conceptual diagrams showing the operating state of the light emitting driver circuit related to the embodiment.

In this manner, when a potential difference occurs between contacts N11 and N12 (between the gate< >source of the thin-film transistor Tr13), the thin-film transistor Tr13 performs an "ON" operation. As seen in FIG. 6A, the write-in current Ia corresponding to the current value of the gradation current Ipix flows toward the data driver 130 from the voltage lines VL via the thin-film transistor Tr13, the contact N12, the thin-film transistor Tr12 and the data lines DL.

At this stage, the electric charge corresponding to the potential difference created between the contacts N11 and N12 (between the gate< >source of the thin-film transistor Tr13) is stored in the storage capacitor Cs and held as the voltage component (electric charge). Additionally, because the power supply voltage Vsc having a voltage level less than the low electric potential voltage Vcath (namely, ground voltage Vgnd) is applied to the voltage lines VL and further controlled so that the write-in current Ia flows in the direction of the data lines DL, the electric potential applied to the anode terminal (contact N12) of the organic EL devices OEL becomes lower than the electric potential (low electric potential voltage Vcath) of the cathode terminal. Thus, because reverse-bias will be applied to the organic EL devices OEL, light emitting drive does not flow into the organic EL devices OEL and a light emitting operation is not performed.

(Light Emitting Operation Period)

Next, in a light emitting operation period Tnse after conclusion of a write-in operation period Tse, as shown in FIG. 7, as a low-level of the scanning signal Vsel is applied from the scan driver 120 to specified scanning lines SL and the appropriate rows of the display pixels EM are set in a non-selective state, a high-level of the power supply voltage Vsc is applied to the voltage lines VL of the appropriate rows of the display pixels EM. Furthermore, synchronizing with this timing, the operation which draws in the gradation current Ipix according to the data driver 130 is suspended.

Accordingly, as the thin-film transistors Tr11 and Tr12 which constitute the light emitting driver circuits DC perform an "OFF" operation, the power supply voltage Vsc to contact N11 (namely, the gate terminal of the thin-film transistor Tr13 and one end of the storage capacitor Cs) is electrically isolated. Because the applied voltage level resulting from the operation which draws in the gradation current Ipix according to the data driver 130 to the contact N12 (namely, the source terminal of the thin-film transistor Tr13 and the other end of the storage capacitor Cs) is electrically isolated, the storage capacitor Cs holds the electric charge stored in the write-in operation period mentioned above.

In this manner, when the storage capacitor Cs holds the charge voltage at the time of a write-in operation, the potential difference between the contacts N11 and N12 (between the gate< >source of the thin-film transistor Tr13) will be held and the thin-film transistor Tr13 maintains an "ON" state. Also, because the power supply voltage Vsc which has a voltage level higher than the low electric potential voltage Vcath is applied to the voltage lines VL, the electric potential applied to the anode terminal (contact N12) of the organic EL devices OEL becomes higher than the electric potential (ground potential) of the cathode terminal.

Figure 6B:
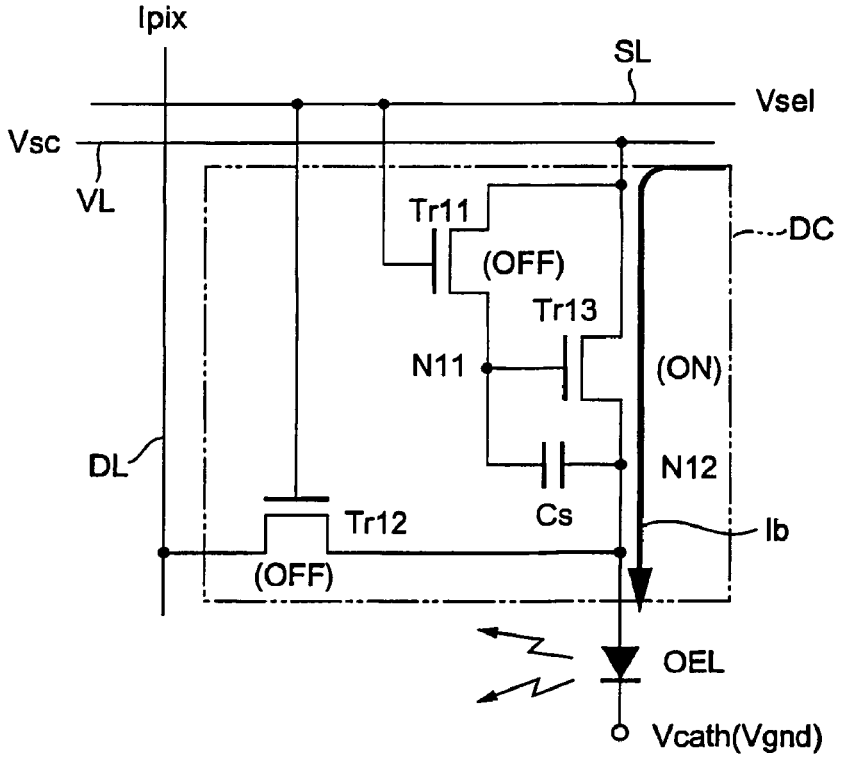

Consequently, as seen in FIG. 6B, the predetermined light emitting drive current Ib flows into the organic EL devices OEL in the direction of forward-bias from the voltage lines VL via the thin-film transistor Tr13 and the contact N12 and the organic EL devices OEL perform a light emitting operation.

Here, because the potential difference (charged voltage) based on the electric charge stored by the storage capacitor Cs is equivalent to the potential difference situation of flowing the write-in current Ia corresponding to the gradation current Ipix in the thin-film transistor Tr13, the light emitting drive current Ib supplied to the organic EL devices OEL will have a current value equivalent to the above-mentioned write-in current Ia. Accordingly, in the light emitting operation period Tnse after a write-in operation period Tse, the light emitting drive current Ib will be continuously supplied via the thin-film transistor Tr13 based on the voltage component corresponding to the display data (gradation current Ipix) written in the write-in operation period Tse and the organic EL devices OEL continue light emitting operation at a luminosity gradation corresponding to the display data.

Then, by sequentially repeating execution of a series of operations mentioned above, among all of the scanning lines SL which constitute the display panel 110, the display data for 1 display panel screen is written in with light emission performed at a predetermined luminosity gradation and the desired image information is displayed.

Notably, as for the thin-film transistors Tr11~Tr13 which are applied to the light emitting driver circuits DC related to this embodiment and although not specifically a limitation, n-channel type amorphous silicon TFTs are favorably applicable by constituting all the thin-film transistors Tr11~Tr13 with n-channel type thin-film transistors. In this case, already established amorphous silicon manufacturing technology can be applied and light emitting driver circuits in which the operating characteristics are stabilized can be produced relatively cheaply.

Moreover, as a configuration which applies predetermined power supply voltage Vsc to the voltage lines VL in the light emitting driver circuits DC related to this embodiment, for example as shown in FIG. 8 and in addition to the configuration of the display device 100A shown in FIG. 1, comprises a power supply driver 180 connected to a plurality of voltage lines VL situated in parallel with each of the scanning lines SL in the display panel 110. At timing (refer to FIG. 7) which synchronizes with the scanning signal Vsel outputted from the scan driver 120, a favorably applicable configuration can be made which applies the power supply voltage Vsc having a predetermined voltage value from the power supply driver 180 to rows (display pixels EM set in a selective state) of the voltage lines VL and applied to the scanning lines SL by the scan driver 120 based on a power source control signal supplied from the system controller 160.

Also, FIG. 8 illustrates a configuration in which the precharge control signal PCG supplied to the precharge circuit 140 and the reset control signal RST supplied to the reset circuit 150 mentioned above are generated and outputted by the scan driver 120. Besides, in the reset circuit 150 containing the reset voltage Vrst mutually applied to the thin-film transistor TRrst (switching element) provided for each of the data lines DL, a configuration is illustrated which provides the low electric potential voltage Vcath (for example, ground voltage Vgnd) connected to the cathode terminal of the above-mentioned organic EL devices OEL.

Furthermore, the display pixels EM mentioned above comprise three thin-film transistors in each of the light emitting driver circuits DC and generates the gradation current (−Ipix) of negative polarity by the data driver 130. Although a circuit configuration is shown corresponding to a current application method style which draws the gradation current Ipix in the direction of the data driver 130 via the data lines from the display pixels EM (light emitting driver circuits DC), the present invention is not limited to this embodiment.

Specifically, for example, a display device which comprises a light emitting driver circuit corresponding to a current application method comprising at least a drive current control circuit (equivalent to the thin-film transistors Tr11, Tr13) which controls supply of the light emitting drive current to a light emitting device. Provided that after holding the gradation current corresponding to the display data with that drive current control circuit (electric charge holding circuit as a voltage component), the light emitting drive current is supplied based on that gradation current and a light emitting operation of the light emitting device is performed at a predetermined luminosity gradation, the device may have other configurations. For example, the circuit configuration may comprise four thin-film transistors. Additionally, the data driver 130 may generate gradation current of positive polarity and may have a circuit configuration corresponding to a style which flows that gradation current in the direction of the display pixels (light emitting driver circuit) via the data lines DL from the data driver 130.

Also, in the embodiment mentioned above, although a configuration applied with organic EL devices is indicated as current control type light emitting devices which constitute the display pixels, the present invention is not restricted to this. Other favorably applicable devices may be applied as a substitute the above-mentioned organic EL devices, for example, Light Emitting Diodes (LEDs) or compatible type light emitting devices. The device primarily necessitates only that the current control type light emitting devices be capable of performing a light emitting operation at a predetermined luminosity gradation corresponding to the current value of the supplied drive current.

<Drive Control Method of the Display Device>

Next, the drive control method in the display device related to this embodiment will be explained.

Figure 9:
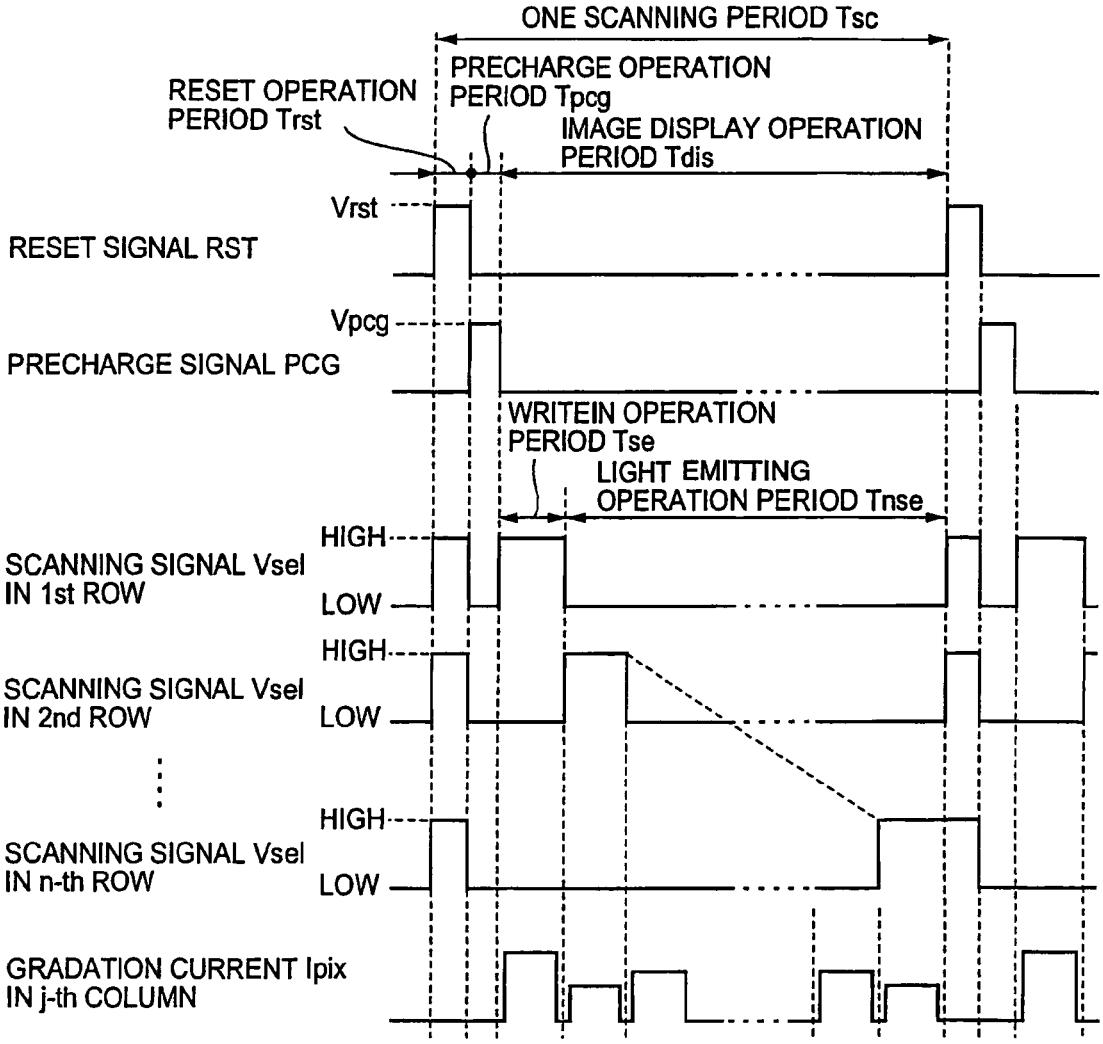
FIG. 9 is a timing chart showing the $1^{st}$ example of the drive control method for the display device related to the $1^{st}$ embodiment.

FIG. 9 is a timing chart showing the 1$^{st}$ example of the drive control method for the display device related to the 1$^{st}$ embodiment.

Figure 10A:
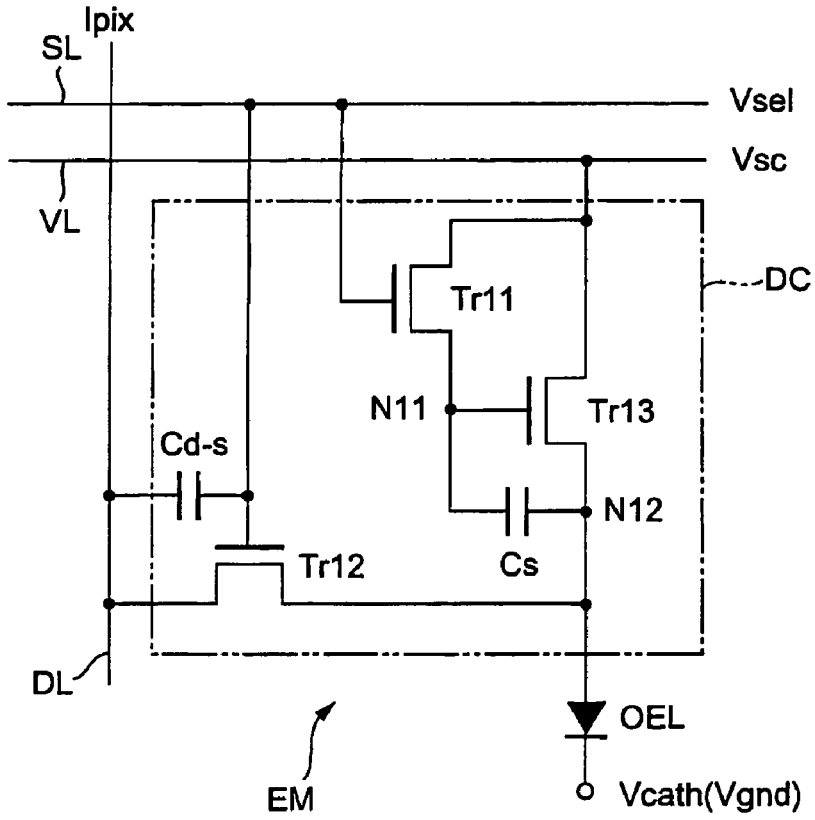
FIGS. 10A~10B are outline circuit diagrams showing the parasitic capacitance attached to the display pixels as applied to the display device related to the $1^{st}$ embodiment and an equivalent circuit which simplifies the circuit configuration of the display pixels.

FIG. 10 is an outline circuit diagram showing the parasitic capacitance attached to the display pixels as applied to the display device related to the 1$^{st}$ embodiment and an equivalent circuit which simplifies the circuit configuration of the display pixels.

FIG. 11 is a conceptual diagram for explaining the precharge operation as applied to the drive control operation of the display device related to the 1$^{st}$ embodiment.

FIG. 12 is a conceptual diagram for explaining accumulation of the electric charge and distribution state in the precharge operation related to the 1$^{st}$ embodiment.

Figure 13:
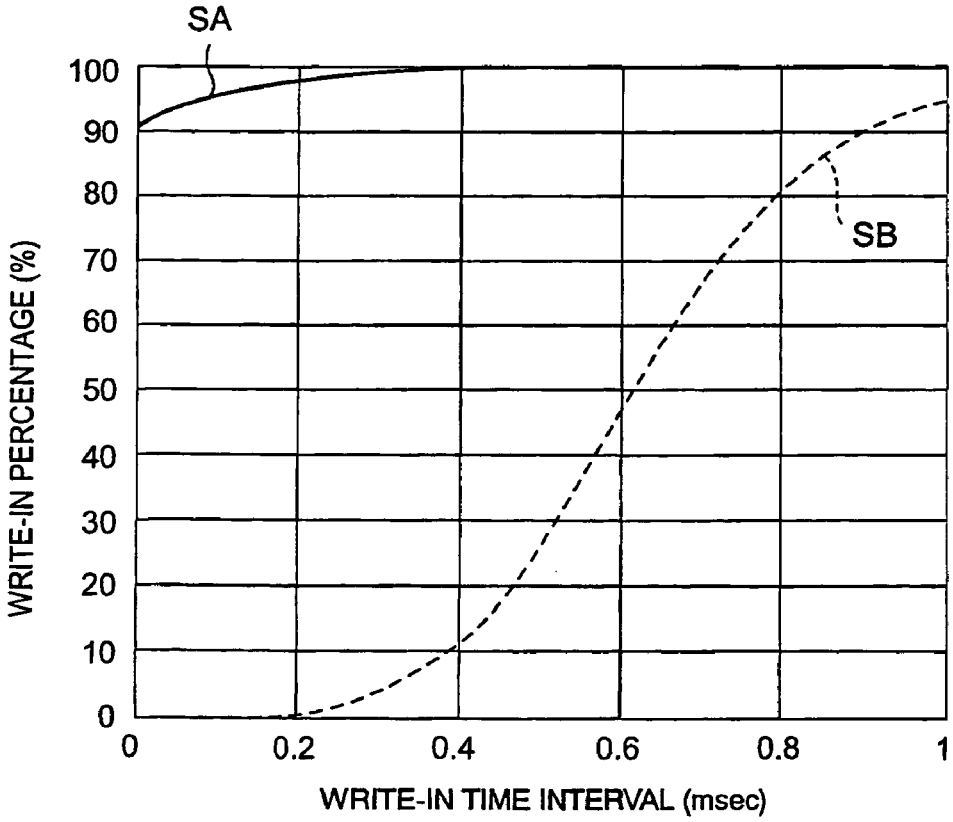
FIG. 13 is a simulation result showing the relationship of the write-in time interval and the write-in percentage for the drive control operation of the display device related to the $1^{st}$ embodiment.

FIG. 13 is a simulation result showing the relationship of the write-in time interval and the write-in percentage for the drive control operation of the display device related to the 1$^{st}$ embodiment.

Here, the drive control method will be explained while accordingly referring to the configuration of the display device shown in FIG. 8.

The drive control method of the display device 100A having the above-stated configuration, for example as seen in FIG. 9, executes settings to include (Tsc . . . Trst+Tpcg+Tdis). One scanning period Tsc denotes 1 cycle. A reset operation period Trst sets all of the display pixels EM situated in the display panel 110 simultaneously in a selective state, discharges at least the electric charge stored (residue) in the storage capacitor Cs of each of the display pixels EM to predetermined power supply voltage and sets all of the display pixels EM in a reset state within that one scanning period Tsc. A precharge operation period Tpcg sets all of the display pixels EM simultaneously in a non-selective state and sets at least the parasitic capacitance attached to all of the data lines DL situated in the display panel 110 in a predetermined charged state after an above-mentioned reset operation period Trst. An image display operation period Tdis consists of the write-in operation period Tse and the light emitting operation period Tnse (refer to FIG. 7) which writes the display data in each row of the display pixels EM (light emitting drive circuits DC) described earlier and performs a light emitting operation at a predetermined luminosity gradation. Here, the reset operation period Trst, the precharge operation period Tpcg and the image display operation period Tdis are established so that a mutual time overlap does not occur.

(Reset Operation Period)

Specifically, in a reset operation period Trst of the display pixels EM, as shown in FIG. 9, as a high-level of the scanning signal Vsel is applied relative to all of the scanning lines SL situated in the display panel 110 from the scan driver 120 and all of the display pixels EM are set in a selective state, a high-level reset control signal RST is supplied to the reset circuit 150 from the scan driver 120 and set in a reset state.

Accordingly, as the thin-film transistor Tr12 provided in the light emitting driver circuit DC (refer to FIG. 5) configuration in each of the display pixels EM performs an "ON" operation due to each of the thin-film transistors TRrst (switching elements) set in the reset circuit 150 performing an "ON" operation, the other end side (contact N12) of the storage capacitor Cs of the light emitting driver circuits DC is connected to the low electric potential voltage Vcath (ground voltage Vgnd) via the thin-film transistor Tr12, the data lines DL and the thin-film transistor TRrst. In this manner, the electric charge stored in the above-mention storage capacitor Cs is discharged to the low electric potential voltage Vcath.

(Precharge Operation Period)

Next, in a precharge operation period Tpcg after conclusion of a reset operation period Trst, as seen in FIG. 9, as a low-level of the scanning signal Vsel is applied from the scan driver 120 to all of the scanning lines SL, all of the display pixels EM are set in a non-selective state and the connection between the data lines DL and the display pixels EM (light emitting driver circuits DC) is electrically isolated. As a result, a high-level of the precharge control signal PCG is supplied to the precharge circuit 140 from the scan driver and set in a precharged state. At this timing, a low-level of the reset control signal RST is supplied to the reset circuit 150 from the scan driver 120 and the connection between the data lines DL and the low electric potential voltage Vcath is electrically isolated.

Accordingly, due to each of the thin-film transistors TRpcg (switching elements) provided in the precharge circuit 140 performing an "ON" operation, the precharge voltage Vpcg (ground voltage Vgnd) is applied to each of the data lines DL via each of the thin-film transistors TRpcg and the parasitic capacitance attached to each of the data lines DL is charged at a predetermined voltage based on the precharge voltage Vpcg.

Specifically, as seen in FIG. 10, in the data lines DL connected to specified display pixels EM, in summary, a capacitor Cd-s is connected within the wiring between the data lines DL and the scanning lines SL (namely, gate terminal of the thin-film transistor Tr12 of the light emitting driver circuits DC) as well as the storage capacitor Cs is connected via the thin-film transistor Tr12 of the light emitting driver circuits DC which can be regarded as attached for parasitic capacitance.

Figure 10B:
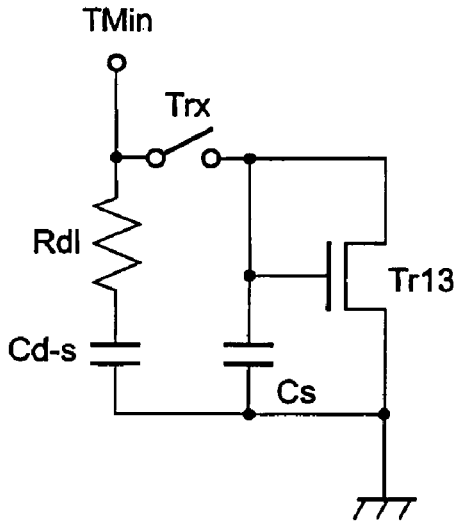

Therefore, when this circuit is simplified as seen in FIG. 10B, a series circuit composed of wiring resistance Rd1 (resistor) of the data lines DL and the capacitor Cd-s within the wiring between the signal input terminal TMin of the data lines DL (for example, connection contact of the display panel 110, the data driver 130 and the precharge circuit 140) and ground voltage (low electric potential voltage Vcath) can be regarded as an equivalent circuit to the series circuit composed of the thin-film transistor Tr12 and the thin-film transistor Tr13 (TFT switches) connected in parallel with the storage capacitor Cs connected between the gate<>source of the thin-film transistor Tr13.

Figure 11A:
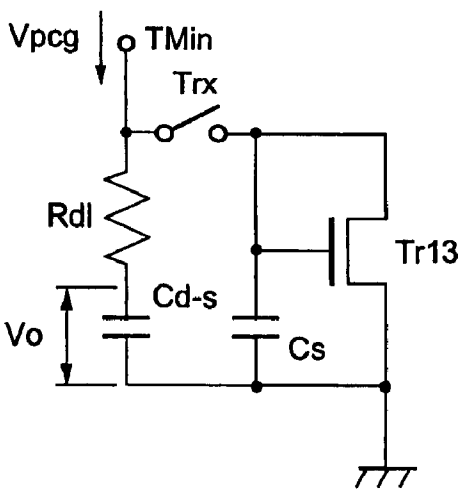
FIGS. 11A~11C are conceptual diagrams for explaining the precharge operation as applied to the drive control operation of the display device related to the $1^{st}$ embodiment.

Based on such an equivalent circuit, as seen in FIG. 11A, due to the above-mentioned precharge operation placing the thin-film transistor Tr12 in the "OFF" state (display pixels EM in a non-selective state), the wiring resistance Rd1 and the capacitor Cd-s within the wiring connected in series between the signal input terminal TMin and ground voltage constitutes an equivalent state and circuit. The precharge voltage Vpcg applied to each of the data lines DL from the precharge circuit 140 via the signal input terminal TMin is stored as a voltage component in the capacitor Cd-s within the wiring. Here, the potential difference (charge voltage) generated at both ends of the capacitor Cd-s within the wiring following the precharge operation is defined as $V_0$. In addition, a detailed setup of the charge voltage $V_0$ based on the precharge voltage Vpcg will be explained in detail in the image display operation.

(Image Display Operation Period)

Next, in an image display operation period Tdis after conclusion of a precharge operation period Tpcg as seen in FIG. 9 and the light emitting drive control method (refer to FIG. 7) of the light emitting driver circuits DC mentioned above, each row of the display pixels EM is sequentially set in a selective state and sequentially executes a write-in operation (write-in operation period Tse) and light emitting operation (light emitting operation period Tnse) while synchronizing with this timing. A write-in operation (write-in operation period Tse) supplies the gradation current Ipix to each of the display pixels EM corresponding to the display data and stores (charges) a voltage component based on the gradation current Ipix ( . . . write-in current Ia) to the storage capacitor Cs provided in each of the display pixels EM (light emitting driver circuits DC). A light emitting operation (light emitting operation period Tnse) supplies light emitting drive current Ib based on the voltage component to the light emitting devices (organic EL devices OEL) and a light emitting operation in those light emitting devices is performed at a luminosity gradation corresponding to the display data.

At this stage, based on the equivalent circuit mentioned above and as shown in FIG. 11B, since above-described write-in operation of the display data places the thin-film transistor Tr12 in an "ON" state (display pixels EM in a selective state), this will constitute an equivalent state and circuits connected in parallel containing a series circuit composed of the wiring resistance Rd1 and the capacitor Cd-s within the wiring in between the signal input terminal TMin and ground voltage and a series circuit composed of the thin-film transistor Tr12 and the thin-film transistor Tr13. Accordingly, the electric charge stored in the capacitor Cd-s within the wiring at the precharge operation state will be distributed (shared) between the capacitor Cd-s within the wiring and the storage capacitor Cs.

By distribution of this electric charge, the potential difference $V_{S0}$ generated at both ends of the storage capacitor Cs and at both ends of the capacitor Cd-s within the wiring becomes equivalent and can be calculated as follows.

Figure 12A:
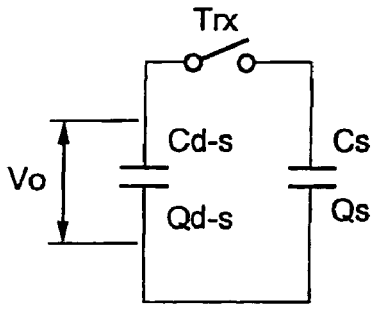
FIGS. 12A~12B are conceptual diagrams for explaining accumulation of the electric charge and distribution state in the precharge operation related to the $1^{st}$ embodiment.
Figure 12B:
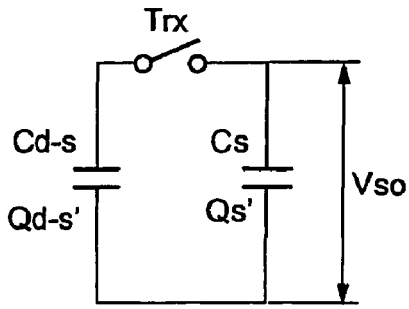

Specifically, since the connected state of the capacity component in the precharge operation state mentioned above places the thin-film transistor Tr12 in an "OFF" state, as shown in FIG. 12A, the capacitor Cd-s within the wiring and the storage capacitor Cs are in a state which is electrically isolated. Here, the voltage $V_0$ based on the precharge voltage Vpcg is charged by the precharge operation described above. Then, when the thin-film transistor Tr12 performs an "ON" operation (constituting a write-in operation state), the connected state of the capacity component as shown in FIG. 12B will switchover to a state where the capacitor Cd-s within the wiring and the storage capacitor Cs are connected in the shape of a loop. Here, equivalent voltage $V_{S0}$ is generated at both ends of the capacitor Cd-s within the wiring and the storage capacitor Cs.

Figure 11B:
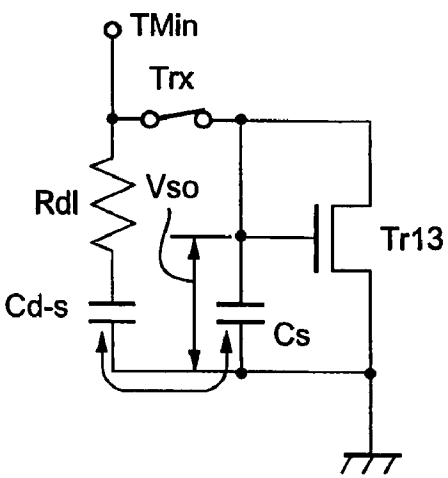

The following (1) equation is based on based on Kirchhoff's Law and acquired by the illustration in FIG. 12B. Here, the equivalent circuit is shown in FIG. 11B directly after the thin-film transistor Tr12 performs an "ON" operation and on the assumption that light emitting drive current Ib is not flowing into the thin-film transistor Tr12 ("ON" operation not performed) Additionally, in equation (1), Qd-s' is the charge amount (quantity of electricity) stored in the capacitor Cd-s within the wiring at a write-in operation state and Qs' is the charge amount stored in the storage capacitor Cs at the same state.

$$V_{S0}=Qs'/Cs=Qd\text{-}s'/Cd\text{-}s \quad (1)$$

Meanwhile, at the shift from a precharge operation state to a write-in operation state (thin-film transistor Tr12 from "OFF" state to an "ON" state), the sum total of the charge amount stored in the capacitor Cd-s within the wiring and the storage capacitor Cs is constant. Also, in a precharge operation state, because it is imaginable that all of the electric charges stored in the storage capacitor Cs are discharged (Qs=0) by a reset operation, the following (2) equation is acquired. Here, Qd-s is the charge amount stored in the storage capacitor Cs in a precharge operation state.

$$Qd\text{-}s+Qs=Qd\text{-}s'+Qs'$$

$$Qd\text{-}s=Qd\text{-}s'+Qs \quad (2)$$

Further, in a precharge operation state, since the capacitor Cd-s within the wiring and the storage capacitor Cs are electrically isolated and a voltage component based on the precharge voltage Vpcg in the storage capacitor Cs is not stored, the following (3) equation is acquired.

$$V_0=Qd\text{-}s/Cd\text{-}s \quad (3)$$

From these (1)~(3) equations, the voltage $V_0$ charge in the capacitor Cd-s within the wiring in the above-mentioned precharge operation can be calculated and the following (4) equation is acquired.

$$\begin{aligned} V_0 &= Qd-s/Cd-s \quad (4)\\ &= (Qd-s'+Qs')/Cd-s\\ &= \{Qd-s'+(Qd-s'\,Cs/Cd-s)\}/Cd-s\\ &= (1+Cs/Cd-s)\,Qd-s'/Cd-s\\ &= (1+Cs/Cd-s)\,V_{SO}\\ &\ldots \end{aligned}$$

In the above-stated (4) equation, the voltage $V_{SO}$ charged in the storage capacitor Cs is set to constitute a voltage value (the lowest luminosity voltage; voltage between gate< >source of the thin-film transistor Tr13) required for supplying (namely, flow to the thin-film transistor Tr13) the light emitting drive current Ib to the organic EL devices OEL, which has a current value when performing a light emitting operation of the organic EL devices OEL at the lowest luminosity gradation. In the precharge operation, the voltage $V_0$ which charges the capacitor Cd-s within the wiring of each of the data lines DL and also the precharge voltage Vpcg are specified.

Figure 11C:
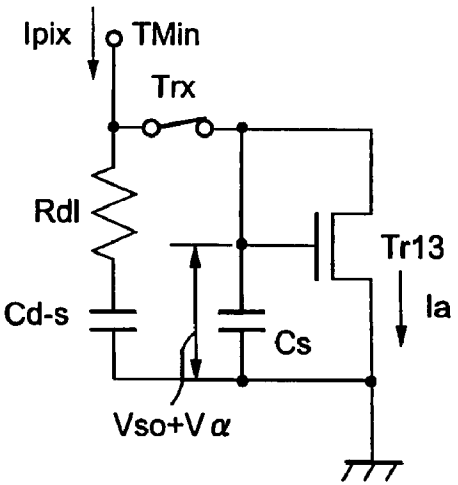

Consequently, as shown in FIG. 11C, by supplying the gradation current Ipix accompanying a write-in operation via the data lines DL after distributing the stored charge in the above-mentioned capacity component, the write-in current Ia having a current value corresponding to the display data flows to the thin-film transistor Tr13. Because the voltage component Vα corresponding to that write-in current Ia will be added to the charge ($V_{SO}$+V . . . ) in the lowest luminosity voltage $V_{SO}$ previously charged in the above-mentioned storage capacitor Cs, in the early stages of the write-in operation (immediately after supplying the gradation current Ipix), the voltage component which appropriately corresponds to the display data can be stored (charged) in the brief write-in time interval without charging the capacitor Cd-s within the wiring and the storage capacitor Cs of the data lines DL.

Accordingly, as seen in FIG. 13, the write-in percentage in relation to a write-in time interval can be dramatically improved, write-in deficiency of the display data can be controlled, a light emitting operation of the organic EL devices can be performed at the proper luminosity gradation and a superior display device with remarkable display image quality can be realized. Additionally, as shown in FIG. 13, the solid line SA is a simulation result which illustrates the transition of the write-in percentage in relation to the write-in time interval in the case of executing a reset operation and a precharge operation related to this embodiment. The dotted line SB is a simulation result which illustrates the transition of the write-in percentage in relation to the write-in time interval in the case of writing direct display data without executing a reset operation and a precharge operation.

Figure 14:
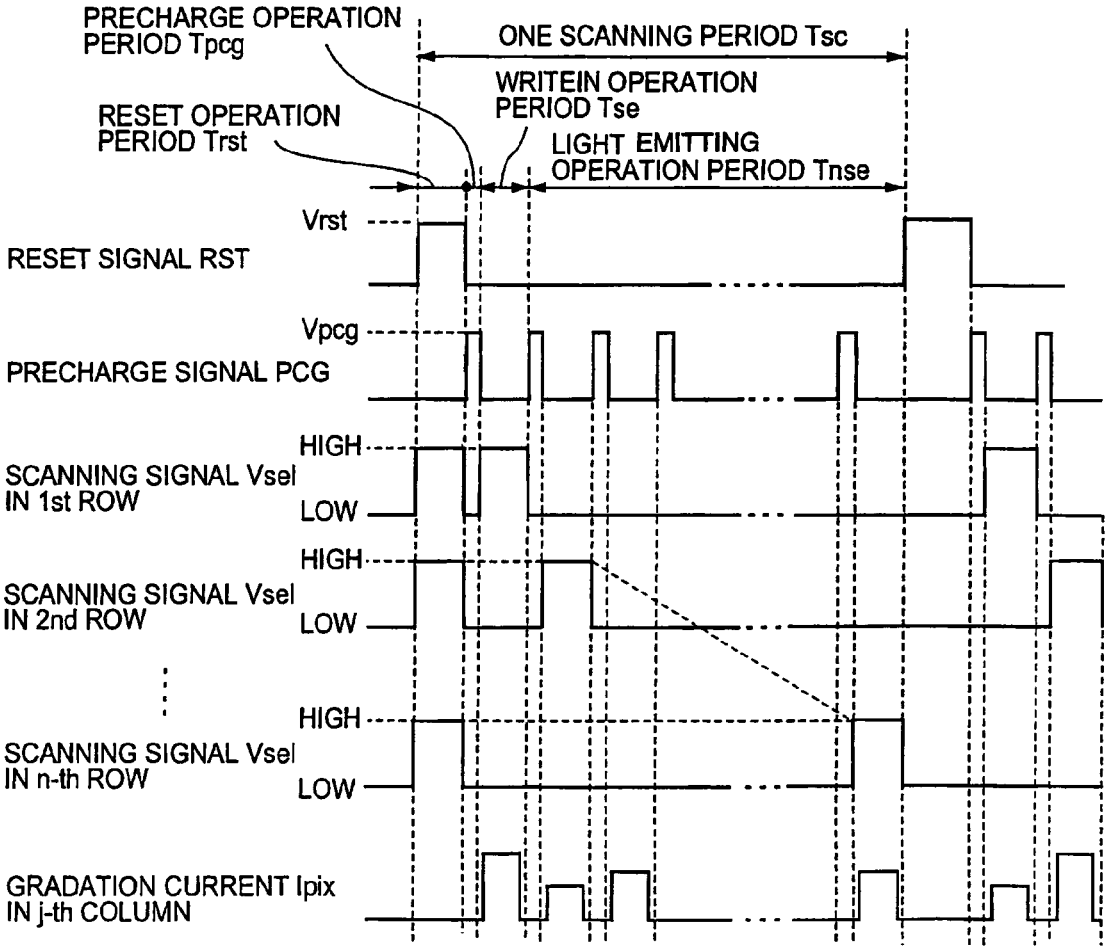
FIG. 14 is a timing chart showing the $2^{nd}$ example of the drive control method for the display device related to the $1^{st}$ embodiment.

FIG. 14 is a timing chart showing the $2^{nd}$ example of the drive control method for the display device related to the $1^{st}$ embodiment.

In the $1^{st}$ example of the drive control method related to the embodiment mentioned above, as seen in FIG. 9, a method of executing (simultaneously) a reset operation relative to all of the display pixels EM and a precharge operation relative to all of the data lines DL are shown batched together respectively, prior to an image display operation (a write-in operation, a light emitting operation) to each row of the display pixels EM. In the $2^{nd}$ example of a drive control method, a technique of separately executing a precharge operation directly before a write-in operation for every row of the display data is applied.

Specifically as shown in FIG. 14, operations sequentially execute for each row a reset operation period Trst, a precharge operation period Tpcg, a write-in operation period Tse and a light emitting operation period Tnse. Initially, a reset operation period Trst simultaneously sets all of the display pixels situated in the display panel 110 in a selective state, discharges the electric charge (residue) stored in at least the storage capacitor Cs of the display pixels EM to predetermined power supply voltage and collectively sets all of the display pixels EM in a reset state. Subsequently, a precharge operation period Tpcg sets the capacitor Cd-s within the wiring attached to all of the data lines DL as a predetermined charged state and a condition in which all of the display pixels EM are simultaneously set in a non-selective state. A write-in operation period Tse charges a voltage component to the storage capacitor Cs and correspondingly supplies the gradation current Ipix (write-in current Ia) relative to the display data. A light emitting operation period Tnse, after a write-in operation period Tse which writes in the display data for 1 display panel screen, displays the image information by performing light emitting of the light emitting devices (organic EL devices OEL) in each of the display pixels EM at a predetermined luminosity gradation.

In such a drive control method, by executing a precharge operation every time directly before a write-in operation of the display data (gradation current Ipix) for every row of the display pixels EM, deterioration (decline) in the elapsed timing of the voltage $V_0$ can be controlled based on the precharge voltage Vpcg charged by the capacitor Cd-s within the wiring of each of the data lines DL. The potential difference $V_{SO}$ generated in the storage capacitor Cs by distributing (sharing) the electric charge between the capacitor Cd-s in early stages of a write-in operation and the storage capacitor Cs can be set to a desired voltage (the $1^{st}$ example mentioned above pertaining to the voltage between gate< >source in the thin-film transistor Tr13 for light emitting drive required for supplying light emitting drive current of the lowest luminosity gradation to the light emitting device; the lowest luminosity voltage) and stored. Thus, write-in percentage variations due to a decline of the above-mentioned voltage $V_0$ can be controlled.

Moreover, in a precharge operation executed prior to an image display operation (a write-in operation and a light emitting operation), although this embodiment describes a case which sets so that the lowest luminosity voltage $V_{SO}$ charges (namely, applied between gate< >source of the thin-film transistor Tr13 for light emitting drive) to the storage capacitor Cs and the voltage $V_0$ (namely, precharge voltage Vpcg) charges to the capacitor Cd-s within the wiring attached to the data lines DL in a write-in operation, the present invention is not limited to this, for example, the voltage $V_{SO}$ charged to the storage capacitor Cs at write-in operation time. The voltage $V_0$ (namely, precharge voltage Vpcg) may be set as voltage (medium luminosity voltage) between gate< >source of the thin-film transistor Tr13 needed for supplying light emitting drive current of medium luminosity gradation to the light emitting devices.

Accordingly, as compared with the case where the voltage $V_{S0}$ charged to the storage capacitor Cs at the time of a write-in operation is charged from the lowest luminosity voltage to the preferred voltage (for example, highest gradation voltage) corresponding to the display data, the direction of the charge from medium luminosity voltage (for example, lower gradation voltage or higher gradation voltage) to the preferred voltage corresponding to that display data can shorten a write-in time interval and further improve the write-in percentage.

Also, in this embodiment although a device configuration and drive control method which execute an image display operation (a write-in operation and a light emitting operation) are shown after executing a reset operation and a precharge operation, the display pixels may be set in a non-selective state and only a precharge operation performed without performing a reset operation of the display pixels. In this manner, the reset circuit 150 shown in FIG. 1, FIG. 2 and FIG. 8 can be omitted. A configuration equivalent (refer to FIG. 15 and FIG. 16) to the $2^{nd}$ embodiment described later can be applied and the circuit configuration of the display device can be miniaturized.

Furthermore, in the write-in percentage versus the write-in time interval in this case, although the dramatic improvement effect as shown in FIG. 13 is not acquired, a substantially improved result is obtained as compared with the case (refer to FIG. 13, dotted line SB) where direct display data is written without executing a precharge operation.

$2^{nd}$ Embodiment

Next, the $2^{nd}$ embodiment of the display device and associated drive control method will be explained with reference to the drawings.

<Display Device>

Figure 15:
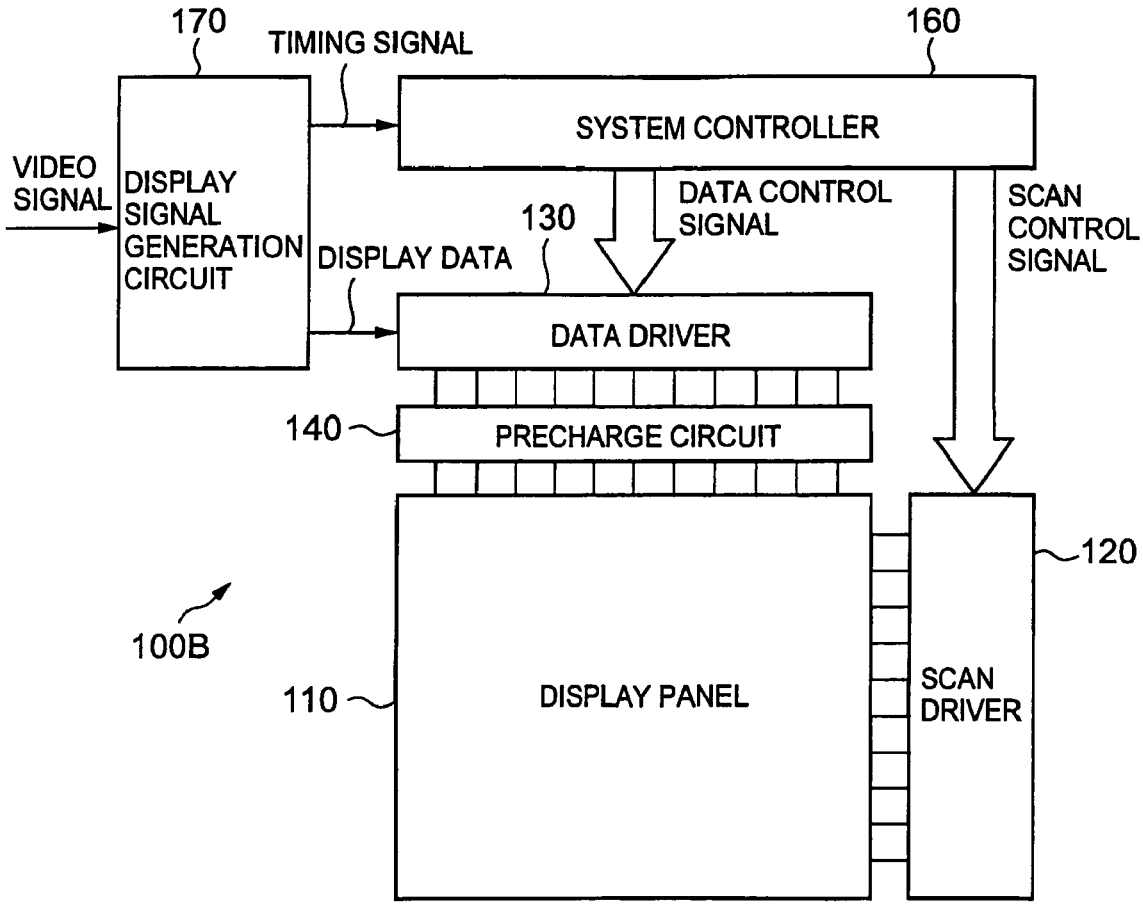
FIG. 15 is a schematic block diagram showing the $2^{nd}$ embodiment of the display device related to the present invention.

FIG. 15 is a schematic block diagram showing the $2^{nd}$ embodiment of the display device related to the present invention.

Figure 16:
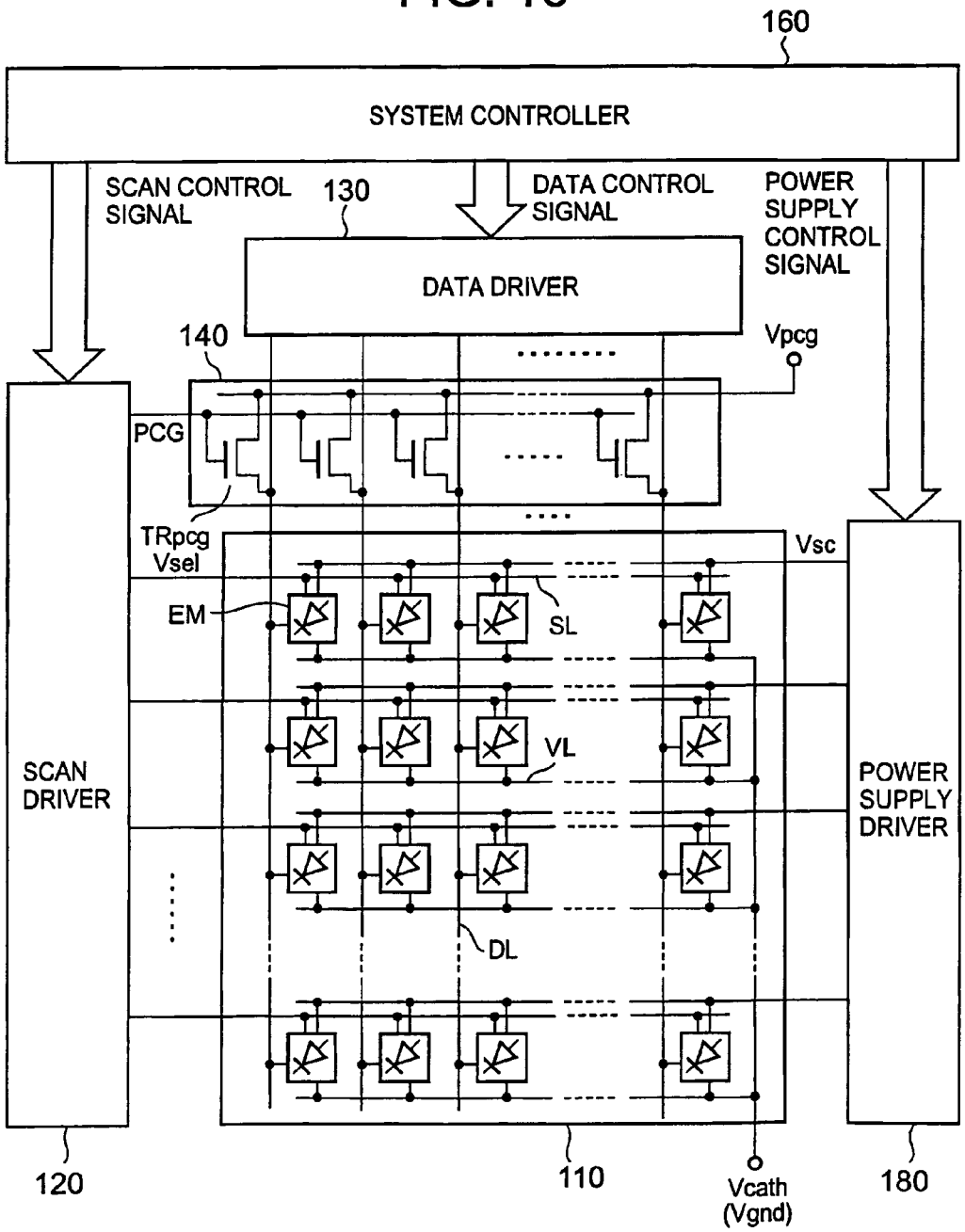
FIG. 16 is an outline configuration diagram showing the substantial part composition of the display device related to the $2^{nd}$ embodiment.

FIG. 16 is an outline configuration diagram showing the substantial part composition of the display device related to the $2^{nd}$ embodiment.

Here, concerning any configuration equivalent to the $1^{st}$ embodiment mentioned above, the same or equivalent nomenclature is appended and the explanation is simplified or omitted.

As seen in FIG. 15, the display device 100B related to this embodiment, in summary, has a configuration like the $1^{st}$ embodiment mentioned above, except the reset circuit 150 is omitted.

Referring to FIG. 16, the display pixels EM situated in the display panel 110 have a configuration comprising a power supply driver 180. The power supply driver 180 applies the power supply voltage Vsc as the scan driver 120 applies the scanning signal Vsel to each row of the display pixels EM. A configuration comprising the light emitting driver circuits DC composed of the three thin-film transistors shown in the $1^{st}$ embodiment can be applied. Also, the precharge control signal PCG controls "ON/OFF" operations of each of the switching elements (thin-film transistors TRpcg) provided in the precharge circuit 140 like the configuration shown in the $1^{st}$ embodiment and configured so as to be generated and outputted by the scan driver 120.

Additionally, the scan driver applied to this embodiment has a configuration composed of the shift register 121 and the output circuit section 122, for example, like the $1^{st}$ embodiment (refer to FIG. 2). In particular, the output circuit section 122 is practicably constituted for switching to a function (mode) which sequentially outputs the scanning signal Vsel to each of the scanning lines SL as well as a function (mode) which simultaneously outputs the scanning signal Vsel to all of the scanning lines SL based on the output control signal SOE.

Here, an operation (image display operation) which supplies the gradation current Ipix to each row of the display pixels EM situated in the display panel 110 and sequentially writes the display data as described later, sets to the mode which sequentially outputs the scanning signal Vsel to each of the scanning lines. Also, an operation (precharge operation) which applies the precharge voltage to all of the display pixels EM situated in the display panel 110 and establishes a predetermined charged state, sets to the mode which simultaneously outputs the scanning signal Vsel to all of the scanning lines SL.

<Drive Control Method of the Display Device>

Next, the drive control method in the display device related to this embodiment will be explained.

Figure 17:
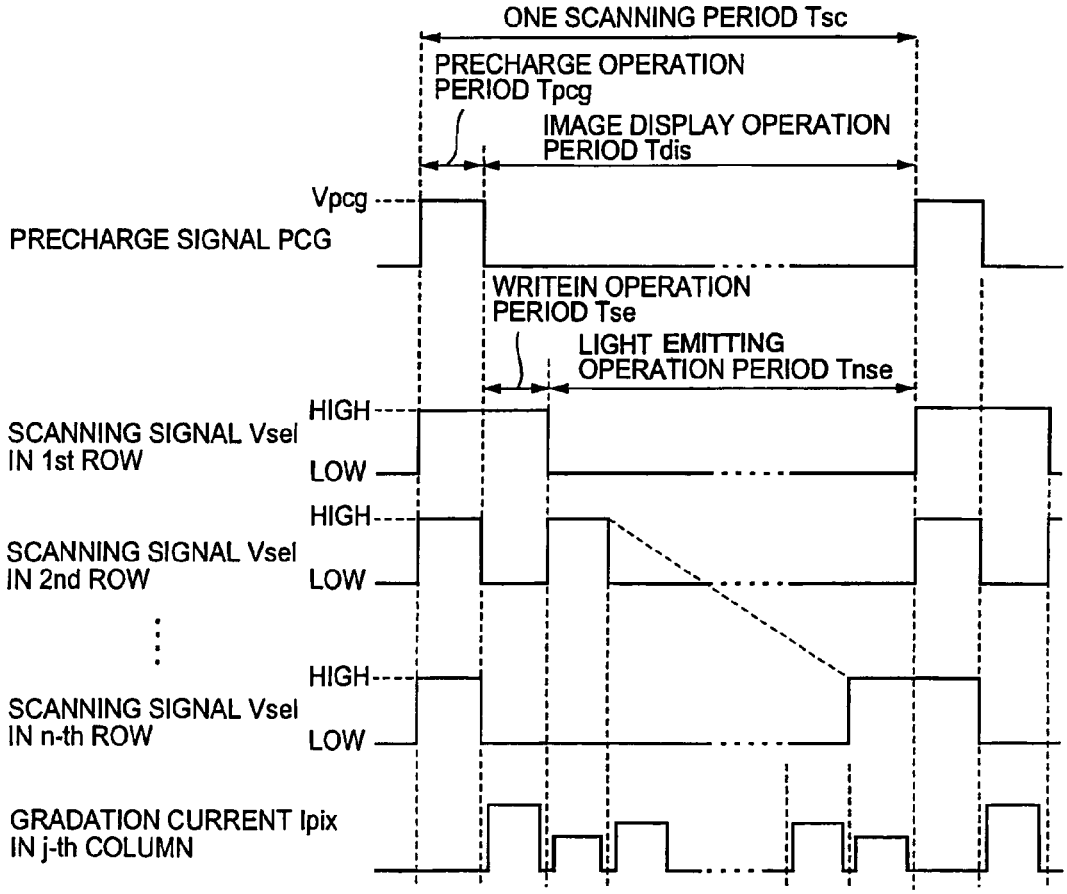
FIG. 17 is a timing chart showing the $1^{st}$ example of the drive control method for the display device related to the $2^{nd}$ embodiment.

FIG. 17 is a timing chart showing the $1^{st}$ example of the drive control method for the display device related to the $2^{nd}$ embodiment.

FIG. 18 is a conceptual diagram for explaining the precharge operation as applied to the drive control operation of the display device related to the $2^{nd}$ embodiment.

Figure 19:
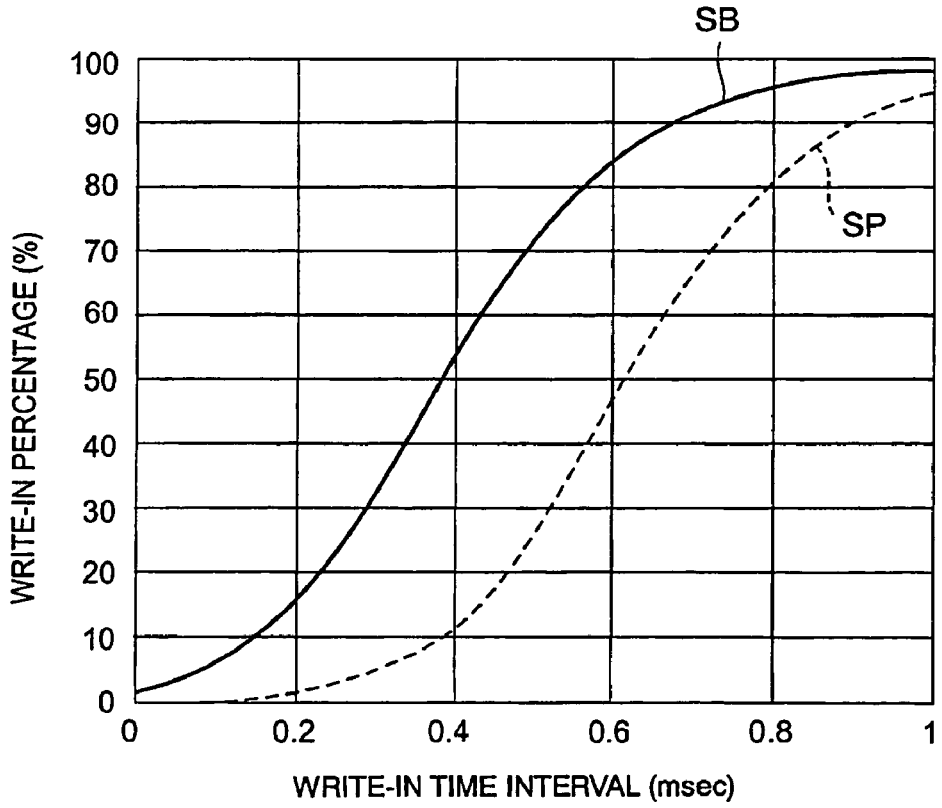
FIG. 19 is a simulation result showing the relationship of the write-in time interval and the write-in percentage for the drive control operation of the display device related to the $2^{nd}$ embodiment.

FIG. 19 is a simulation result showing the relationship of the write-in time interval and the write-in percentage for the drive control operation of the display device related to the $2^{nd}$ embodiment.

Here, the drive control method will be explained while accordingly referring to the configuration of the display device shown in FIG. 16 and an equivalent circuit of the light emitting driver circuit (display pixel) shown in FIG. 10.

The drive control method in the display device 100B has a configuration mentioned above, for example as shown in FIG. 17, which executes settings to include (Tsc>=Tpcg+Tdis). One scanning period Tsc denotes 1 cycle. A precharge operation period Tpcg simultaneously sets all of the display pixels EM situated in the display panel 110 in a selective state and sets at least the storage capacitor Cs provided in each of the display pixels EM as a predetermined charged state. An image display operation period Tdis is composed of a write-in operation period and a light emitting operation period Tnse (refer to FIG. 7) which writes the display data of each row of the display pixels EM (light emitting driver circuits DC) mentioned above and performs a light emitting operation at a predetermined luminosity gradation. Here, the precharge operation period Tpcg and the image display operation period Tdis are established so that a mutual time overlap does not occur.

(Precharge Operation Period)

Referring to FIG. 17, in a precharge operation period Tpcg, initially, as a high-level of the scanning signal Vsel is applied to all of the scanning lines SL situated in the display panel 110 from the scan driver 120 and all of the display pixels EM are set in a selective state, a high-level of the precharge control signal PCG is supplied to the precharge circuit from the scan driver and set in a precharged state.

Accordingly, as the thin-film transistor Tr12 provided in the light emitting driver circuit DC (refer to FIG. 5) which constituted in each of the display pixels EM performs an "ON" operation, due to each of the thin-film transistors TRpcg (switching elements) provided in the precharge circuit 140 performing an "ON" operation, the precharge voltage Vpcg is applied to the other end side (contact N12) of the storage capacitor Cs in the light emitting driver circuits DC via each of the thin-film transistors TRpcg and each of the data lines DL. The capacitor Cd-s within the wiring attached to each of the data lines DL and the storage capacitor Cs of each of the display pixels EM (light emitting driver circuits DC) store the electric charge.

Figure 18A:
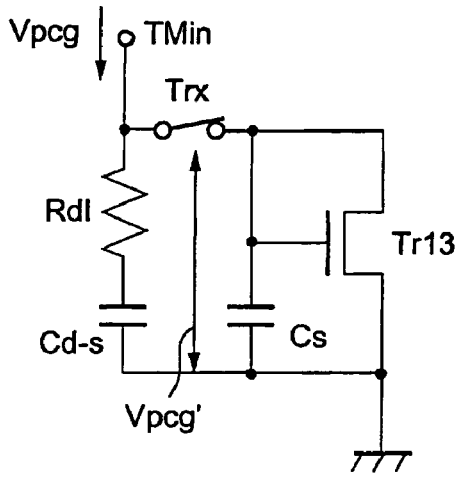
FIGS. 18A~18B are a conceptual diagrams for explaining the precharge operation as applied to the drive control operation of the display device related to the $2^{nd}$ embodiment.

Specifically, based on an equivalent circuit of the light emitting driver circuits DC as seen in FIG. 10B, due to the precharge operation placing the thin-film transistor Tr12 in an "ON" state (display pixels EM in a selective state) as shown in FIG. 18A, the series circuit composed of wiring resistance Rd1 (resistor) and the capacitor Cd-s within the wiring between the signal input terminal TMin and ground voltage and can be regarded as an equivalent state and circuit to the series circuit composed of the thin-film transistors Tr12 and Tr13 which are connected in parallel with the storage capacitor Cs connected between the gate< >source of the thin-film transistor Tr13. Also, these equivalent circuits can be further set in a state (thin-film transistor Tr13 "OFF" state) where current does not flow via the thin-film transistors Tr12 and Tr13.

Accordingly, in an equivalent circuit as illustrated in FIG. 18A, the precharge voltage Vpcg is applied to each of the data lines DL and each of the display pixels EM via the signal input terminal TMin and stored as a mutually equivalent voltage component to the series circuit composed of the wiring resistance Rd1 and the capacitor Cd-s within the wiring, as well as to the storage capacitor Cs. Here, following the precharge operation, the potential difference Vpcg' (equivalent to voltage between gate< >source of the thin-film transistor Tr13) generated to the series circuit composed of the wiring resistance Rd1 and the capacitor Cd-s within the wiring or to both ends of the storage capacitor Cs is equivalent to a threshold value voltage Vth of the thin-film transistor Tr13 or set as a lower value as defined (Vpcg'<=Vth).

(Image Display Operation Period)

Next, in an image display operation period Tdis after conclusion of a precharge operation period Tpcg as seen in FIG. 17 and the light emitting drive control method (refer to FIG. 7) of the light emitting driver circuits DC mentioned above, each row of the display pixels EM is sequentially set in a selective state and sequentially executes a write-in operation (write-in operation period Tse) and a light emitting operation (light emitting operation period Tnse). A write-in operation stores a voltage component based on the gradation current Ipix ( . . . write-in current Ia) to the storage capacitor Cs of each of the display pixels EM (light emitting driver circuits DC) corresponding to the display data. A light emitting operation supplies the light emitting drive current Ib to the light emitting devices (organic EL devices OEL) based on that voltage component and performs a light emitting operation at a luminosity gradation corresponding to the display data.

Figure 18B:
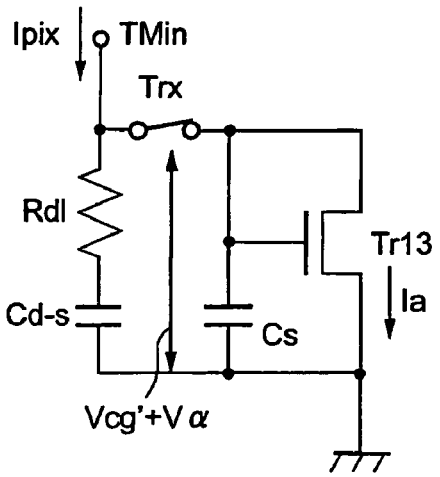

At this stage, in a write-in operation of the display data, a high-level of the scanning signal Vsel is sequentially applied to each of the scanning lines from the scan driver 120 due to sequentially setting each row of the display pixels EM in a selective state and supplying the gradation current Ipix via the data lines DL. As shown in FIG. 18B, the thin-film transistor Tr12 performs an "ON" operation, because the write-in current Ia has a current value corresponding to the display data flowing into the thin-film transistor Tr13. As the voltage component V . . . corresponds to that write-in current Ia, this will be added to the voltage Vpcg' previously charged in the storage capacitor Cs and charged (Vpcg'+V . . . ).

Consequently, by a precharge operation, the voltage Vpcg' previously charged less than the threshold value voltage Vth of the thin-film transistor Tr13 for light emitting drive and the voltage component V . . . corresponds to the gradation current Ipix ( . . . write-in current Ia) based on the display data can be charged in a write-in operation so that it can be added (supplemented) to that voltage Vpcg'. In the early stages of a write-in operation (immediately after supplying the gradation current Ipix), the voltage component appropriately corresponding to the display data can be stored in the write-in time interval without charging the capacitor Cd-s within the wiring of the data lines DL or the storage capacitor Cs of the display pixels EM.

Accordingly, although the simulation result seen in FIG. 19 is less than the 1$^{st}$ embodiment described above, the write-in percentage in relation to the time interval can be markedly improved, write-in display deficiency of the display data can be controlled, light emitting operation of the organic EL devices can be performed at proper luminosity gradation and distinctive improvement in the display image quality can be achieved. Additionally, referring to FIG. 19, the solid line SB is the simulation result which illustrates the transition of the write-in percentage in relation to the write-in time interval in the case of executing a precharge operation related to this embodiment. The dotted line SB is a simulation result which illustrates the transition of the write-in percentage in relation to the write-in time interval in the case of writing direct display data without executing a precharge operation.

Figure 20:
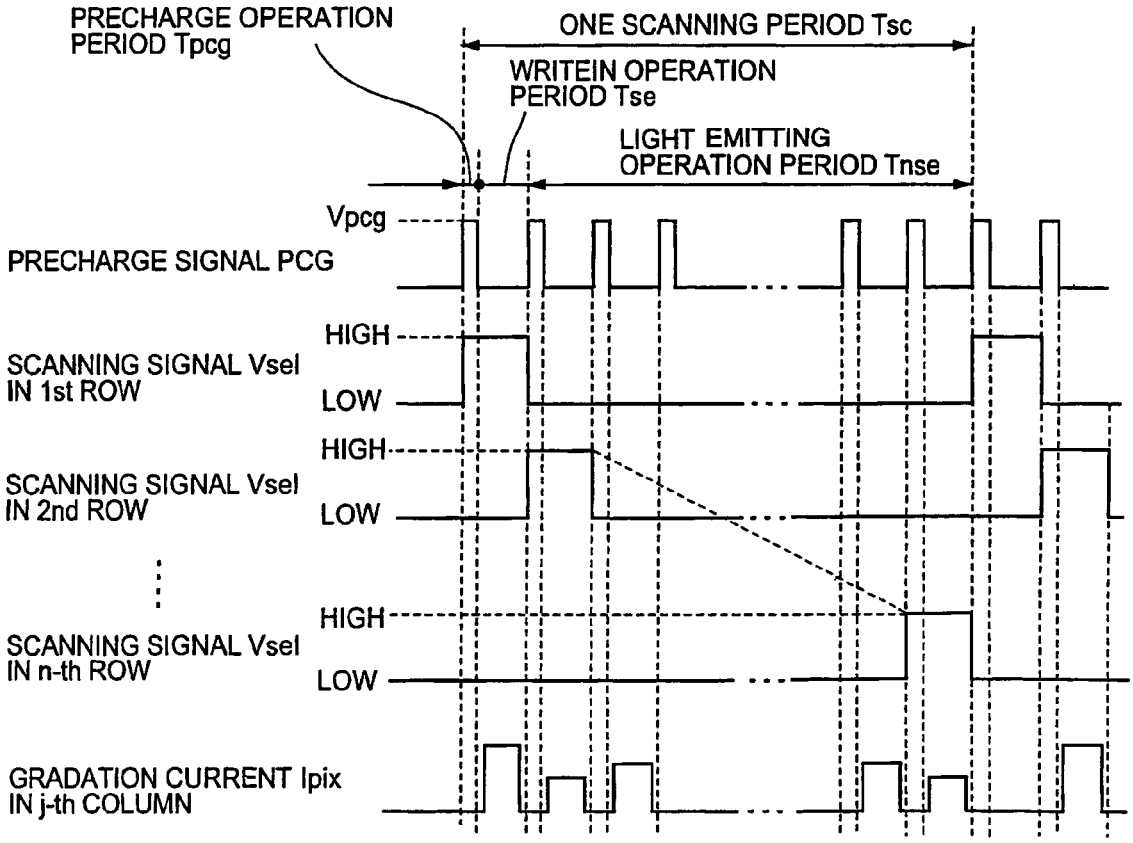
FIG. 20 is a timing chart showing the $2^{nd}$ example of the drive control method for the display device related to the $2^{nd}$ embodiment.

FIG. 20 is a timing chart showing the 2$^{nd}$ example of the drive control method for the display device related to the 2$^{nd}$ embodiment.

Referring to FIG. 17, in the 1$^{st}$ example of the drive control method related to this embodiment, a method of executing (simultaneously) a precharge operation to all of the display pixels prior to an image display operation to each row of the display pixels EM is shown. In this 2$^{nd}$ example of the drive control method, a technique of executing a precharge directly before a write-in operation for every row of the display data is applied.

Specifically, as seen in FIG. 20 in a situation with each row of the display pixels EM set in a selective state and operations are sequentially executed for each row. Initially, a precharge operation period Tpcg sets the capacitor Cd-s within the wiring attached to all of the data lines DL and the storage capacitor Cs provided in the display pixels EM in a predetermined precharged state. A write-in operation period Tse charges a voltage component to the storage capacitor Cs and corresponding supplies the gradation current Ipix (write-in current Ia) relative to the display data. A light emitting operation period Tnse, after a write-in operation period Tse which writes in the display data for 1 display panel screen, displays the image information by performing light emission of the light emitting devices (organic EL devices OEL) in each of the display pixels EM at a predetermined luminosity gradation.

Also in such a drive control method like the 2$^{nd}$ example indicated in the 1$^{st}$ embodiment mentioned above, by executing a precharge operation every time directly before a write-in operation of the display data (gradation current Ipix) to each row of the display pixels EM, deterioration (decline) in the elapsed timing of the voltage Vpcg' based on the precharge voltage Vpcg charged in the storage capacitor Cs of each row of the display pixels EM can be controlled. The voltage Vpcg' can be set and stored in the preferred voltage (1$^{st}$ example mentioned above regarding the thin-film transistor Tr13 light emitting drive which is less than the threshold value voltage Vth).

Additionally, in a precharge operation of the 1$^{st}$ embodiment described above, the voltage $V_0$ charges the capacitor Cd-s within the wiring attached to each of the data lines DL provided in the display panel 110. The above-stated (4) equation as defined has a relationship ($V_0$=(1+Cs/Cd-s)$V_{SO}$) by multiplying a constant relevant to the ratio (Cs/Cd-s) of the capacitor Cd-s within the wiring of the data lines DL and the storage capacitor Cs of the display pixels EM (light emitting driver circuits DC) to the voltage $V_{S0}$ for supplying light emitting drive current at the time of performing a light emitting operation at the lowest luminosity gradation in each of the display pixels EM. In the event the storage capacitor Cs is set higher as compared with the capacitor Cd-s within the wiring (Cs>>Cd-s), the voltage $V_0$ (namely, precharge voltage Vpcg) which charges the capacitor Cd-s within the wiring will become an extremely high voltage value and necessitate use of a high voltage power supply as the precharge voltage Vpcg. Accordingly, power consumption will increase.

On the other hand, in a precharge operation, the voltage Vpcg' charges the storage capacitor CS provided in the display pixels EM (light emitting driver circuits DC) and the method of setting the thin-film transistor Tr13 for light emission below the threshold value Vth is applied. In this manner, as the voltage Vpcg' (namely, precharge voltage Vpcg) can be set at a relatively low voltage value, a display device can be readily realized in which any power consumption increase in that display device can be precisely controlled.

3$^{rd}$ Embodiment

Next, the 3$^{rd}$ embodiment of the display device and associated drive control method will be explained with reference to the drawings.

Because the display device related to this embodiment, in summary, has the same configuration as the 1$^{st}$ embodiment (FIG. 1, FIG. 2, FIG. 8) mentioned above, a detailed explanation about each configuration is omitted.

Figure 21:
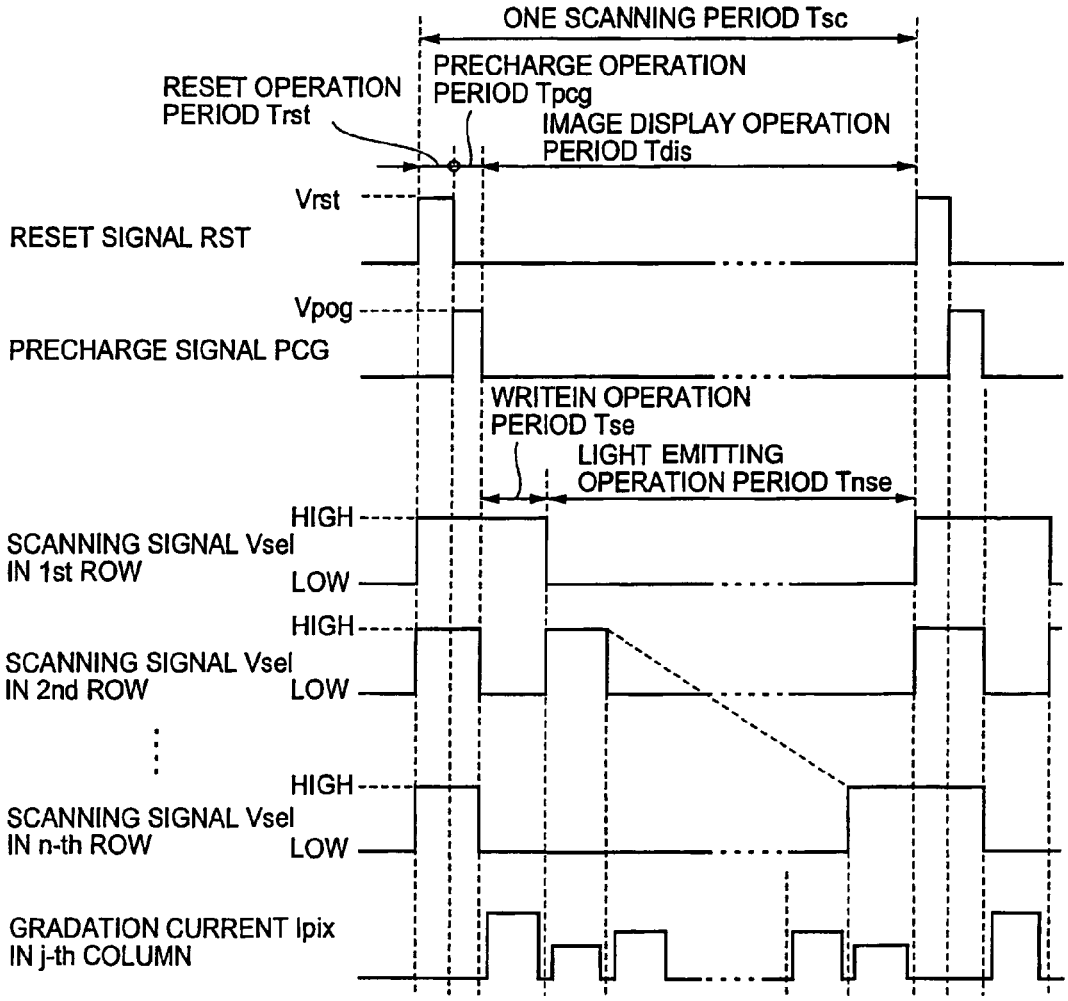
FIG. 21 is a timing chart showing the $1^{st}$ example of the drive control method for the display devices related to the $3^{rd}$ embodiment.

FIG. 21 is a timing chart showing the 1$^{st}$ example of the drive control method for the display devices related to the 3$^{rd}$ embodiment.

Figure 22:
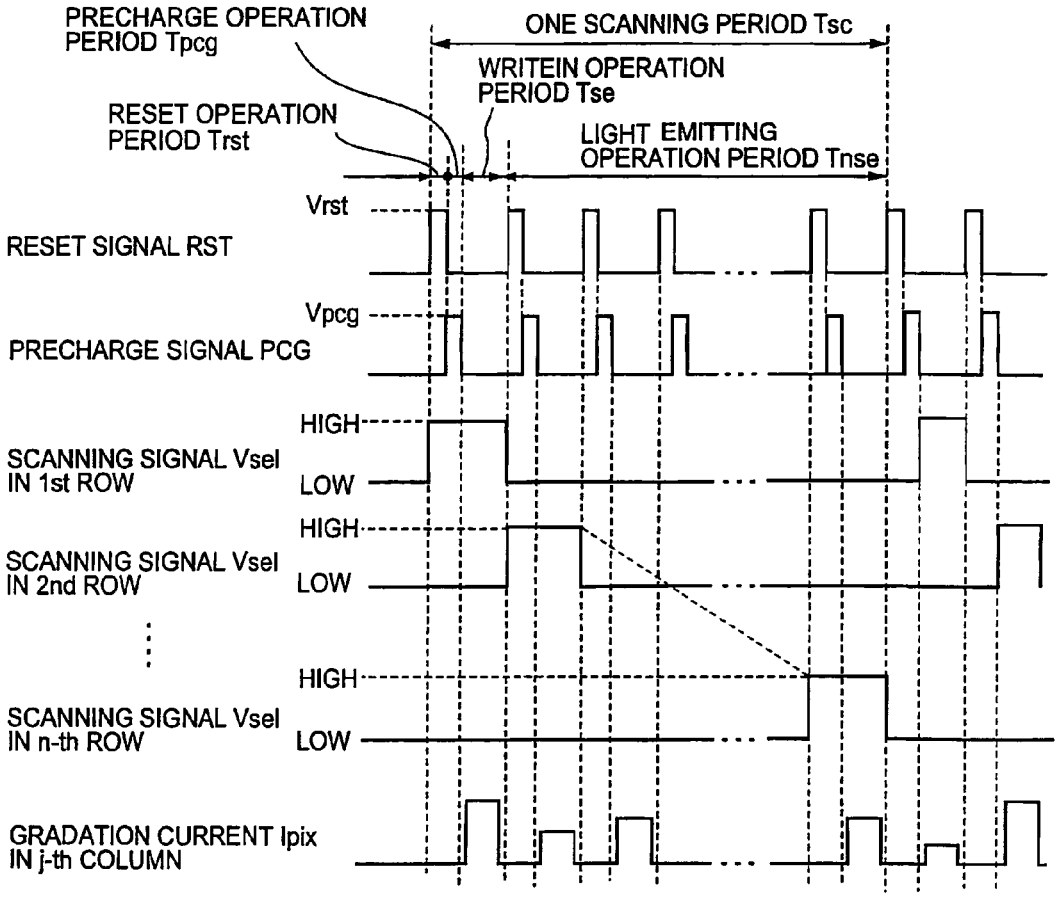
FIG. 22 is a timing chart showing the $2^{nd}$ example of the drive control method for the display devices related to the $3^{rd}$ embodiment.

FIG. 22 is a timing chart showing the 2$^{nd}$ example of the drive control method for the display devices related to the 3$^{rd}$ embodiment.

Here, the drive control method will be explained while accordingly referring to the configuration of the display device shown in FIG. 8 and the light emitting driver circuit (display pixel) shown in FIG. 5.

In the drive control method related to the 1$^{st}$ embodiment mentioned above, a method is described in which as a precharge operation is executed after a reset operation, all of the display pixels are set in a non-selective state and the precharge voltage Vpcg is applied as well as the capacitor Cd-s within the wiring attached to each of the data lines DL is set in a predetermined charged state. In this embodiment, after a reset operation, all of the display pixels EM are set in a selective state and the precharge voltage Vpcg is applied. Also, a method of executing a precharge operation which sets at least the storage capacitor Cs provided in each of the display pixels EM in a predetermined charged state is applied.

Specifically, the 1st example of the drive control method related to this embodiment is shown in FIG. 21, operations sequentially execute for each row a reset operation period Trst, a precharge operation period Tpcg, a write-in operation period Tse and a light emitting operation period Tnse. Initially, a reset operation period Trst simultaneously sets all of the display pixels situated in the display panel 110 in a selective state, discharges the electric charge stored in at least the storage capacitor Cs of the display pixels EM to predetermined power supply voltage and collectively sets all of the display pixels EM in a reset state. Subsequently, a precharge operation period Tpcg, after setting the capacitor Cd-s within the wiring attached to all of the data lines DL and the storage capacitor CS provided in all of the display pixels in a predetermined charged state based on the precharge voltage Vpcg, a write-in operation period Tse charges a voltage component V . . . to the storage capacitor Cs and correspondingly supplies the gradation current Ipix (write-in current Ia) relative to the display data. A light emitting operation period Tnse performs light emission of the light emitting devices (organic EL devices OEL) at a luminosity gradation corresponding to the display data and the display data for 1 display panel screen segment is displayed as image information.

In such a drive control method, prior to an image display operation (a write-in operation, a light emitting operation) in each row of the display pixels EM and like the reset operation described in the 1$^{st}$ embodiment mentioned above, after discharging the electric charge stored in the storage capacitor Cs of all of the display pixels EM, the voltage Vpcg' less than the threshold value voltage Vth of the thin-film transistor Tr13 for light emitting drive is charged to the storage capacitor Cs as the precharge operation indicated in the 2$^{nd}$ embodiment mention above. Subsequently, the method applied of charging the voltage component V . . . corresponds to the gradation current Ipix based on the display data so that it can be added to the storage capacitor Cs. A phenomenon in which the voltage value stored in the storage capacitor Cs varies at the time of a precharge operation due to residual electric charges in the storage capacitor Cs of each of the display pixels can be controlled. As a direct result, the voltage component corresponding to the display data can be appropriately charged at the time of a write-in operation.

Consequently, in the early stages of a write-in operation, the voltage component appropriately corresponding to the display data can be stored in the write-in time interval without charging the capacitor Cd-s within the wiring of the data lines DL or the storage capacitor Cs of the display pixels EM and result in marked improvement in the write-in percentage. Based on the voltage component, light emitting drive having a current value appropriately corresponding to the display data can be supplied to the light emitting devices, light emitting operation of each display pixel (light emitting devices) can be performed at proper luminosity gradation and distinctive improvement in the display image quality can be achieved.

The 2$^{nd}$ example of the drive control method related to this embodiment applies a method of executing a reset operation and a precharge operation individually directly before a write-in operation for each row of the display data.

Specifically, as shown in FIG. 22, in a reset operation period Trst the display pixels EM are set in a selective state. The electric charge (residue) stored at least in the storage capacitor Cs in each of the display pixels EM is discharged to predetermined power supply voltage (low electric potential voltage Vcath) and the appropriate row of display pixels EM is set as a reset state. Subsequently, in a precharge operation period Tpcg, after setting the capacitor Cd-s within the wiring attached to each of the data lines DL and the storage capacitor Cs provided in rows of the display pixels EM in a predetermined charged state (for example, the charged state of the thin-film transistor Tr13 for light emitting drive where the voltage Vpcg' is less than the threshold value voltage Vth)

based on the precharge voltage Vpcg, the appropriate row of the display pixels EM is set in a selective state. In a write-in operation period Tse, a sequence of operations charges the voltage component V . . . to the storage capacitor Cs of the appropriate row of the display pixels EM corresponding to the gradation current Ipix (write-in current Ia) relative to the display data and executed so that a time overlap does not occur. The light emitting device (organic EL device) of each row of the display pixels EM perform light emission at a luminosity gradation corresponding to the display data and the display data for 1 display panel screen segment is displayed as image information.

Based on such a drive control method, a reset operation and a precharge operation are executed every time directly before a write-in operation of the display data (gradation current Ipix) to each row of the display pixels EM while controlling variations of the voltage Vpcg' based on the precharge voltage Vpcg charged in the storage capacitor Cs of the appropriate row of the display pixels EM. Because a decline due to the elapsed time of the voltage Vpcg' can be controlled and a voltage component corresponding appropriately to the display data can be stored in a brief write-in time interval, the write-in percentage can be improved. Based on that voltage component, a light emitting operation of each display pixel (light emitting device) can be performed at a luminosity gradation appropriately corresponding to the display data and substantial improvement of the display image quality can be realized.

While the present invention has been described with reference to the preferred embodiments, it is intended that the invention be not limited by any of the details of the description therein but includes all the embodiments which fall within the scope of the appended claims.

What is claimed is:

1. A display device which displays image information based on display data comprising:

a display panel which includes a plurality of signal lines and a plurality of scanning lines situated in directions mutually intersecting each other, a plurality of display pixels including current control type light emitting devices and active devices positioned near intersecting points of the plurality of signal lines and the plurality of scanning lines, wherein one end of a current path between a source and a drain of each of the active devices is connected to one end of a respective one of the light emitting devices, the display panel further including a plurality of power supply lines to which one of a first power supply voltage and a second power supply voltage, which is different in an electric potential from the first power supply voltage, is applied for setting an operating state of the light emitting devices, wherein each of the plurality of power supply lines is connected to the other end of the current path of respective active devices;

a scan driver circuit which applies a scanning signal to each of the plurality of scanning lines and sets the display pixels connected to the scanning lines in a selective state;

a signal driver circuit which generates gradation current based on display data luminosity gradation component, wherein the gradation current is supplied to the display pixels set in the selective state by the scan driver circuit via each of the plurality of signal lines;

a precharge circuit which applies a precharge voltage to each of the plurality of signal lines and sets a capacity component attached to each of the plurality of signal lines in a predetermined charged state;

a power supply driver which supplies the first or second power supply voltage to the plurality of power supply lines; and an operation control circuit which controls setting of the display pixels in a non-selective state by the scan driver circuit and which applies, by the power supply driver, the first power supply voltage that sets the light emitting devices in a non-light emitting state, when the capacity component is set in the predetermined charged state by the precharge circuit, and which controls setting of the display pixels in the non-selective state by the scan driver circuit and which applies, by the power supply driver, the second power supply voltage that sets the light emitting devices in a light emitting state, when the light emitting devices are set in the light emitting state;

wherein the scan driver circuit generates and outputs a precharge control signal which controls an operating state of the precharge circuit.

2. A display device which displays image information based on display data comprising:

a display panel which includes a plurality of signal lines and a plurality of scanning lines situated in directions mutually intersecting each other, a plurality of display pixels including current control type light emitting devices and active devices positioned near intersecting points of the plurality of signal lines and the plurality of scanning lines, wherein one end of a current path between a source and a drain of each of the active devices is connected to one end of a respective one of the light emitting devices, the display panel further including a plurality of power supply lines to which one of a first power supply voltage and a second power supply voltage, which is different in an electric potential from the first power supply voltage, is applied for setting an operating state of the light emitting devices, wherein each of the plurality of power supply lines is connected to the other end of the current path of respective active devices;

a scan driver circuit which applies a scanning signal to each of the plurality of scanning lines and sets the display pixels connected to the scanning lines in a selective state;

a signal driver circuit which generates gradation current based on display data luminosity gradation component, wherein the gradation current is supplied to the display pixels set in the selective state by the scan driver circuit via each of the plurality of signal lines;

a precharge circuit which applies a precharge voltage to each of the plurality of signal lines and sets a capacity component attached to each of the plurality of signal lines in a predetermined charged state;

a reset circuit which discharges an electric charge stored at least in the display pixels and sets the display pixels in a reset state;

a power supply driver which supplies the first or second power supply voltage to the plurality of power supply lines; and an operation control circuit which: (i) controls setting of the display pixels in a non-selective state by the scan driver circuit and which applies, by the power supply driver, the first power supply voltage that sets the light emitting devices in a non-light emitting state, when the capacity component is set in the predetermined charged state by the precharge circuit, (ii) controls setting of the display pixels in the non-selective state by the scan driver circuit and which applies, by the power supply driver, the second power supply voltage that sets the light emitting devices in a light emitting state, when the light emitting devices are set in the light emitting state, and (iii) controls setting of the display pixels in the selective state by the scan driver circuit when discharging the electric charge stored in the display pixels by the reset circuit;

wherein the scan driver circuit comprises means for generating and outputting a reset control signal for controlling an operating state of the reset circuit.

3. A display device which displays image information based on display data comprising:

a display panel which includes a plurality of signal lines and a plurality of scanning lines situated in directions mutually intersecting each other, a plurality of display pixels including current control type light emitting devices and active devices positioned near intersecting points of the plurality of signal lines and the plurality of scanning lines, wherein a first end of a current path between a source and a drain of each of the active devices is connected to a first end of a respective one of the light emitting devices and a second end of the respective one of the light emitting devices is set to a constant electric potential, the display panel further including a plurality of power supply lines to which one of a first power supply voltage and a second power supply voltage, which is different in an electric potential from the first power supply voltage, is applied for setting an operating state of the light emitting devices, wherein each of the plurality of power supply lines is located respectively along each of the plurality of scanning lines and connected to a second end of the current path of respective active devices for each of the display pixels corresponding to each of the scanning lines;

a scan driver circuit which applies a scanning signal to each of the plurality of scanning lines and sets the display pixels connected to the scanning lines in a selective state;

a signal driver circuit which generates gradation current based on display data luminosity gradation component, wherein the gradation current is supplied to the display pixels set in the selective state by the scan driver circuit via each of the plurality of signal lines;

a precharge circuit which applies a precharge voltage to each of the plurality of signal lines and sets a capacity component attached to each of the plurality of signal lines in a predetermined charged state;

a power supply driver which supplies the first or second power supply voltage to each of the plurality of power supply lines; and an operation control circuit which controls setting of the display pixels in a non-selective state by the scan driver circuit and which applies, by the power supply driver, the first power supply voltage that sets the light emitting devices in a non-light emitting state, when the capacity component is set in the predetermined charged state by the precharge circuit, and which controls setting of the display pixels in the non-selective state by the scan driver circuit and which applies, by the power supply driver, the second power supply voltage that sets the light emitting devices in a light emitting state, when the light emitting devices are set in the light emitting state;

wherein the scan driver circuit generates and outputs a precharge control signal which controls an operating state of the precharge circuit.

4. A display device which displays image information based on display data comprising:

a display panel which includes a plurality of signal lines and a plurality of scanning lines situated in directions mutually intersecting each other, a plurality of display pixels including current control type light emitting devices and active devices positioned near intersecting points of the plurality of signal lines and the plurality of scanning lines, wherein a first end of a current path between a source and a drain of each of the active devices is connected to a first end of a respective one of the light emitting devices and a second end of the respective one of the light emitting devices is set to a constant electric potential, the display panel further including a plurality of power supply lines to which one of a first power supply voltage and a second power supply voltage, which is different in an electric potential from the first power supply voltage, is applied for setting an operating state of the light emitting devices, wherein each of the plurality of power supply lines is located respectively along each of the plurality of scanning lines and connected to a second end of the current path of respective active devices for each of the display pixels corresponding to each of the scanning lines;

a scan driver circuit which applies a scanning signal to each of the plurality of scanning lines and sets the display pixels connected to the scanning lines in a selective state;

a signal driver circuit which generates gradation current based on display data luminosity gradation component, wherein the gradation current is supplied to the display pixels set in the selective state by the scan driver circuit via each of the plurality of signal lines;

a precharge circuit which applies a precharge voltage to each of the plurality of signal lines and sets a capacity component attached to each of the plurality of signal lines in a predetermined charged state;

a reset circuit which discharges an electric charge stored at least in the display pixels and sets the display pixels in a reset state;

a power supply driver which supplies the first or second power supply voltage to each of the plurality of power supply lines; and an operation control circuit which controls setting of the display pixels in a non-selective state by the scan driver circuit and which applies, by the power supply driver, the first power supply voltage that sets the light emitting devices in a non-light emitting state, when the capacity component is set in the predetermined charged state by the precharge circuit, which controls setting of the display pixels in the non-selective state by the scan driver circuit and which applies, by the power supply driver, the second power supply voltage that sets the light emitting devices in a light emitting state, when the light emitting devices are set in the light emitting state, and which controls setting of the display pixels in the selective state by the scan driver circuit when discharging the electric charge stored in the display pixels by the reset circuit;

wherein the scan driver circuit comprises means for generating and outputting a reset control signal for controlling an operating state of the reset circuit.

* * * * *